US011858590B1

(12) United States Patent
Nicholson

(10) Patent No.: US 11,858,590 B1
(45) Date of Patent: Jan. 2, 2024

(54) PORTABLE SAILBOAT MAST HOIST SYSTEM AND METHOD OF USE

(71) Applicant: Leslie Ann Nicholson, Quakertown, PA (US)

(72) Inventor: Leslie Ann Nicholson, Quakertown, PA (US)

( * ) Notice: Subject to any disclaimer, the term of this patent is extended or adjusted under 35 U.S.C. 154(b) by 0 days.

(21) Appl. No.: 18/118,321

(22) Filed: Mar. 7, 2023

Related U.S. Application Data

(60) Provisional application No. 63/317,564, filed on Mar. 8, 2022.

(51) Int. Cl.
*B63B 15/02* (2006.01)
*B63B 15/00* (2006.01)

(52) U.S. Cl.
CPC ..... *B63B 15/02* (2013.01); *B63B 15/0083* (2013.01); *B63B 2015/0058* (2013.01)

(58) Field of Classification Search
CPC ..... B63B 15/00; B63B 2015/0016; B63B 2015/005; B63B 2015/0058; B63B 2015/0066; B63B 15/0083; B60R 9/06; B60P 3/1066
See application file for complete search history.

(56) References Cited

U.S. PATENT DOCUMENTS 3,507,240 A 4/1970 Butler
3,565,271 A 2/1971 Deck
3,678,876 A 7/1972 Alter
3,827,386 A 8/1974 Faden
3,885,689 A * 5/1975 Grove ..... B60P 3/1025 414/462
3,898,948 A 8/1975 Huff
3,976,213 A * 8/1976 Ball ..... B60P 3/1025 414/549
4,259,917 A 4/1981 Frank
5,051,056 A 9/1991 Gibbons
5,456,564 A 10/1995 Bianchini
5,865,136 A * 2/1999 Alexander ..... B63B 15/0083 114/91
6,499,610 B2 12/2002 Spitsbergen
6,990,916 B1 1/2006 Atwood, Jr.
(Continued)

FOREIGN PATENT DOCUMENTS

AU 2007101101 A4 1/2008
AU 2012100925 A4 7/2012
(Continued)

*Primary Examiner* — Andrew Polay
(74) *Attorney, Agent, or Firm* — Allen D. Hertz. P.A.; Allen D. Hertz

(57) ABSTRACT

A mast righting assistance assembly includes a trailer hitch extension subassembly includes a trailer hitch extension insert and a trailer hitch extension receiver tube extending opposite directions, a winch subassembly carried by the trailer hitch extension subassembly, and a vertical column carried by the trailer hitch extension subassembly. A winch cable is routed from a winch drum through a cable redirecting component attached to a top of the vertical column. The cable is secured to rigging of the mast for controlling stepping and unstepping of the mast. The winch spools and unspools the cable to step and unstep the mast respectively. The vertical column is adjustable in height to obtain a desirable minimum force application angle respective to stowed mast.

20 Claims, 14 Drawing Sheets

(56) References Cited

U.S. PATENT DOCUMENTS

| | | | | |
|---|---|---|---|---|
| 7,614,356 | B2 | 11/2009 | Knisely | |
| 8,191,322 | B2 | 6/2012 | Liestenfeltz | |
| 9,254,988 | B1 * | 2/2016 | Caspersen | B66C 23/44 |
| 9,694,876 | B1 | 7/2017 | Smith | |
| 11,192,614 | B2 | 12/2021 | Peleg | |
| 2004/0213655 | A1 | 10/2004 | Buckner | |
| 2004/0234367 | A1 | 11/2004 | Pacini | |
| 2008/0035042 | A1 | 3/2008 | Smith | |
| 2008/0141918 | A1 * | 6/2008 | McClintock | B63B 15/02 114/90 |
| 2011/0100278 | A1 | 5/2011 | McClintock | |
| 2013/0319311 | A1 * | 12/2013 | Balfour | B63B 15/0083 114/91 |
| 2015/0034000 | A1 * | 2/2015 | Beriou | B63B 15/02 114/91 |

FOREIGN PATENT DOCUMENTS

| | | | |
|---|---|---|---|
| DE | 10253531 | A1 | 6/2004 |
| ES | 2830926 | T3 | 6/2021 |
| FR | 2535671 | A1 | 5/1984 |
| FR | 2920405 | A1 | 3/2009 |
| GB | 2437386 | A | 10/2007 |
| GB | 2534963 | A | 8/2016 |
| WO | WO1987002322 | A1 | 4/1987 |
| WO | WO1995024334 | A1 | 9/1995 |

* cited by examiner

PORTABLE SAILBOAT MAST HOIST SYSTEM AND METHOD OF USE

CROSS REFERENCE TO RELATED APPLICATIONS

This application is a Non-Provisional Utility Application claiming the benefit of co-pending U.S. Provisional Patent Application Ser. No. 63/317,564, filed on Mar. 8, 2022, which is incorporated by reference herein in its entirety.

FIELD OF THE INVENTION

The present disclosure generally relates to a system for aiding a sailing enthusiast in raising and lowering a mast of a sailboat for trailing. More specifically, the system includes a winch and a telescoping column carried by a trailer hitch extension that is installed between a trailer hitch receiver on a vehicle and a trailer hitch.

BACKGROUND OF THE INVENTION

Most masts on sailboats are designed to be raised and lowered for trailing. Even with the best designs, the masts are bulky, due to their length introduce awkward torsional forces, making the masts difficult to handle, particularly when the sailing enthusiast is solo. In addition to the forces required to raise and/or lower the masts, the length of the masts also tend to fall towards one side or the other when partly raised from a seated orientation or lowered from an upright orientation. The awkwardness of the masts introduce a risk of personal injury to the sailing enthusiast and those around the vessel as well as potential damage to the vessel.

In one known solution, a manual winch is mounted to a rigid angled member that extends upwards from a trailer. The rigid angled member is mounted at a located between two hulls of a catamaran. The system is limited for use with the trailer that the system is mounted there upon. The rigid angled member limits the torque that can be applied to the mast, thus limiting lateral control of the mast during the raising/lowering processes. The disclosure requires the use of a prop to incline the mast upward from the step at a minor acute angle before the winch can become effective. This reference is directed towards solving the lateral control of the mast by introducing a pair of lateral control members (sidestays) to provide lateral support to the mast.

What is desired is a system that aids a sailing enthusiast in raising and lowering a mast of a sailboat. It is desired that the system is portable, enabling use for more than one sailboat and easily stored when not in use.

BRIEF DESCRIPTION OF THE INVENTION

The present disclosure generally relates to an apparatus and a method of use of the apparatus to aid in raising and lowering a mast of a sailboat for trailing.

In a general scope of the present invention, a mast pivotal orientation assembly includes:

a trailer hitch extension subassembly including a trailer hitch extension insert extending in a first longitudinal direction and a trailer hitch extension receiver tube extending in a second, opposite longitudinal direction;

a winch carried by the trailer hitch extension subassembly, and a generally vertically oriented column extending upwards from the trailer hitch extension subassembly;

a winch cable arranged to be spooled onto and unspooled from a drum operated by a winch motor; and a winch cable redirecting component attached to an upper region of the generally vertically oriented column, wherein in use, the winch cable is routed from the winch drum, redirected via the winch cable redirecting component and secured to a mast control line, the mast control line being secured to an upper region of the mast, in a mast stepping process, a length of the winch cable is collected onto a drum of the winch causing the mast to rise, and in a mast unstepping process, a length of the winch cable is unspooled from the drum of the winch causing the mast to lower.

In a second aspect, the generally vertically oriented column is extendable.

In another aspect, the generally vertically oriented column is extendable, the generally vertically oriented column comprising a plurality of column members that are adjustably assembled to one another enabling adjustment of a height of the vertically oriented column.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a mechanical member inserted at least partially through each of the adjacent column members.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a pin inserted at least partially through each of the adjacent column members.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a clevis pin inserted at least partially through each of the adjacent column members.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a clevis pin inserted at least partially through each of the adjacent column members, wherein the clevis pin is retained by a hairpin.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a pin portion of a securing pin inserted at least partially through each of the adjacent column members.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a pin portion of a safety coupler pin inserted at least partially through each of the adjacent column members.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a pin portion of a square safety coupler pin inserted at least partially through each of the adjacent column members.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a pin portion of a D shaped safety coupler pin inserted at least partially through each of the adjacent column members.

In another aspect, the generally vertically oriented column is extendable, the generally vertically oriented column comprising a plurality of column members that are adjustably assembled to one another enabling adjustment of a height of the vertically oriented column, wherein two adjacent column members are retained in a vertical relation with one another by a threaded member inserted at least partially through each of the adjacent column members.

In another aspect, the generally vertically oriented column is telescoping.

In another aspect, the generally vertically oriented column is telescoping, the generally vertically oriented column comprising a plurality of column members that are adjustably assembled to one another.

In another aspect, the generally vertically oriented column is telescoping, the generally vertically oriented column comprising a plurality of column members that are adjustably assembled to one another enabling adjustment to a height of the vertically oriented column.

In another aspect, the generally vertically oriented column is telescoping, the generally vertically oriented column comprising a plurality of column members that are slideably assembled to one another.

In another aspect, the generally vertically oriented column is telescoping, the generally vertically oriented column comprising a plurality of column members that are slideably assembled to one another in a nested arrangement.

In another aspect, the generally vertically oriented column is telescoping, the generally vertically oriented column comprising a plurality of tubular column members that are slideably assembled to one another in a nested arrangement.

In yet another aspect, the generally vertically oriented column is removably assembled to the trailer hitch extension subassembly.

In yet another aspect, the generally vertically oriented column is removably assembled to a receptacle carried by the trailer hitch extension subassembly.

In yet another aspect, the generally vertically oriented column is removably assembled to a receptacle carried upon a top surface of the trailer hitch extension subassembly.

In yet another aspect, the generally vertically oriented column is removably assembled to a bracket carried by the trailer hitch extension subassembly.

In yet another aspect, the generally vertically oriented column is removably assembled to a bracket carried upon a top surface of the trailer hitch extension subassembly.

In yet another aspect, the generally vertically oriented column is removably assembled to a bracket assembled to a side surface of the trailer hitch extension subassembly.

In yet another aspect, the generally vertically oriented column is removably assembled through an aperture formed through the trailer hitch extension subassembly.

In yet another aspect, the generally vertically oriented column is removably assembled within a cavity formed within the trailer hitch extension subassembly.

In yet another aspect, the generally vertically oriented column is removably assembled within a cavity formed at least partially extending into the trailer hitch extension subassembly.

In yet another aspect, the generally vertically oriented column is removably assembled to a trailer hitch assembly.

In yet another aspect, the generally vertically oriented column is removably assembled to a portion of the trailer hitch assembly.

In yet another aspect, the generally vertically oriented column is removably assembled to a ball mounted upon the trailer hitch assembly.

In yet another aspect, the winch is mounted to the trailer hitch extension subassembly by at least one mechanical fastener.

In yet a aspect, the winch is mounted to the trailer hitch extension subassembly by a plurality of mechanical fasteners.

In yet a aspect, the winch is mounted to the trailer hitch extension subassembly by a plurality of mechanical fasteners, wherein at least one mechanical fastener is a threaded fastener.

In yet a aspect, the winch is mounted to the trailer hitch extension subassembly by a plurality of mechanical fasteners and at least one mounting plate.

In yet a aspect, the winch is mounted to the trailer hitch extension subassembly by a plurality of mechanical fasteners, a first mounting plate and a second mounting plate.

In yet a aspect, the winch is mounted to the trailer hitch extension subassembly by at least one mechanical fastener, wherein one or more of the at least one mechanical fastener is a "U" shaped fastener.

In yet a aspect, the winch is mounted to the trailer hitch extension subassembly by at least one weld.

In yet a aspect, the winch is electrically coupled to a vehicle power.

In yet a aspect, the winch is electrically coupled to the vehicle power by a connector.

In yet a aspect, the winch is electrically coupled to the vehicle power by a connector, wherein the connector provides electro-mechanical coupling between the winch and the vehicle power.

In yet another aspect, the trailer hitch extension subassembly further comprising a trailer hitch extension receiver locking aperture passing through the trailer hitch extension receiver tube portion thereof.

In yet another aspect, the trailer hitch extension subassembly further comprising a trailer hitch extension receiver locking aperture passing through the trailer hitch extension insert portion thereof.

In yet a aspect, the trailer hitch extension receiver tube further comprising an interior wall defining a tubular opening for receiving a trailer hitch insert of a trailer hitch.

In yet another aspect, the trailer hitch extension receiver tube further comprising an interior wall defining a tubular opening sized for snugly receiving a trailer hitch insert of a trailer hitch.

In yet a aspect, the block is secured to the generally vertically oriented column.

In yet a aspect, a block attachment member is carried by an upper portion of the generally vertically oriented column.

In yet another aspect, the block attachment member is assembled to the upper portion of the generally vertically oriented column.

In yet another aspect, the block attachment member is an eye bolt.

In yet a aspect, the eye bolt is assembled to the upper portion of the generally vertically oriented column by inserting the eye bolt through an aperture and threadably fastening a nut to a side opposite a formed eye of the eye bolt.

In yet another aspect, the eye bolt is assembled to the upper portion of the generally vertically oriented column by inserting the eye bolt through an aperture located proximate a top of the column and threadably fastening a nut to a side opposite a formed eye of the eye bolt.

In yet another aspect, the block is secured to an upper portion of the generally vertically oriented column.

In yet another aspect, the block is secured to an upper portion of the generally vertically oriented column by a cable.

In yet another aspect, the block is secured to an upper portion of the generally vertically oriented column by a carabineer.

In yet a aspect, the winch cable further comprising a loop formed at a distal, free end thereof.

In yet a aspect, the mast is pivotally assembled to the sailboat.

In yet another aspect, the mast is pivotally assembled to a deck portion of the sailboat.

In yet another aspect, the mast is pivotally assembled to a deck portion of the sailboat using a mast pivot assembly.

In yet a aspect, the mast pivot assembly comprising a hinge.

In yet another aspect, the mast pivot assembly comprising a pivot to mast assembly feature and a mast receiving base feature pivotally assembled to one another by a hinge.

In yet another aspect, the mast pivot assembly comprising a pivot to mast assembly feature assembled to mast pivot hinge arm, the assembled to mast pivot hinge arm and a mast receiving base feature pivotally assembled to one another by a hinge.

In yet a aspect, the pivot to mast assembly feature is removably assembled to a base region of the mast.

In yet another aspect, the pivot to mast assembly feature is slideably assembled to the base region of the mast.

In yet another aspect, the pivot to mast assembly feature is slideably assembled into a receiving slot formed within the base region of the mast.

In yet another aspect, the pivot to mast assembly feature is slideably assembled into a receiving slot formed within an interior of the base region of the mast.

In yet a aspect, the mast receiving base feature having a peripheral wall that is sized and shaped to engage with a base portion of the mast.

In yet another aspect, the mast receiving base feature having a peripheral wall that is sized and shaped to engage with an interior wall of the mast.

In yet another aspect, the mast receiving base feature having a peripheral wall that is sized and shaped to engage with the interior wall of the base portion of the mast.

In yet another aspect, the mast receiving base feature having a peripheral wall that is sized and shaped to engage with an exterior wall of the mast.

In yet another aspect, the mast receiving base feature having a peripheral wall that is sized and shaped to engage with the exterior wall of the base portion of the mast.

In accordance with the present invention, a method for raising a mast on a sailboat, the method comprising steps of:

adjusting a height of a height adjustable column to a desired height;

routing a free end of a winch cable through a cable direction changing member secured to a top region of the height adjustable column and securing the free end of the winch cable to a mast control line;

collecting a portion of the winch cable onto a drum causing the mast to pivot about a mast pivot hinge from a substantially horizontal orientation to an upright orientation; and securing the mast in the upright orientation.

In yet another aspect, the method further comprising a step of assembling the mast to the mast pivot hinge.

In yet another aspect, the method further comprising a step of mechanically joining the mast and the mast pivot hinge to one another.

In yet another aspect, the method further comprising a step of slideably assembling the mast to the mast pivot hinge.

In yet another aspect, the method further comprising a step of securing the cable direction changing member to the top region of the height adjustable column.

In yet another aspect, the method further comprising a step of securing the cable direction changing member to the top region of the height adjustable column, wherein the cable direction changing member is any component used to change a direction of a flexible elongated member, such as a cable, a rope, a wire, and the like.

In yet another aspect, the method further comprising a step of securing the cable direction changing member to the top region of the height adjustable column, wherein the cable direction changing member is an eye or a loop.

In yet another aspect, the method further comprising a step of securing the cable direction changing member to the top region of the height adjustable column, wherein the cable direction changing member is a block.

In yet another aspect, the method further comprising a step of securing the cable direction changing member to the top region of the height adjustable column, wherein the cable direction changing member is a block, the block comprising a sheave rotationally assembled to a shell.

In yet another aspect, the method further comprising a step of securing the cable direction changing member to the top region of the height adjustable column, wherein the cable direction changing member is a block, the block comprising the sheave rotationally assembled to an interior of the shell, and an eye assembled to an exterior of the shell.

In yet another aspect, the method further comprising a step of securing a port and a starboard lateral control member to respective sides of the mast.

In yet another aspect, the method further comprising a step of securing a port and a starboard lateral control member to respective sides of the mast, wherein the lateral control members are lines.

In yet another aspect, the method further comprising a step of securing a port and a starboard lateral control member to respective sides of the mast and a distal location of a laterally extending member that extends horizontally and laterally from a pivot hinge assembled to the mast, wherein the lateral control members are lines.

In yet another aspect, the method further comprising a step of securing a port and a starboard lateral control member to respective sides of the mast and a distal location of a laterally extending member that extends horizontally and laterally from a pivot hinge assembled to the mast, wherein the lateral control members are lines, wherein each laterally extending member is pivotally assembled to a base portion of the mast.

In yet another aspect, the method further comprising a step of securing a port and a starboard lateral control member to respective sides of the mast and a distal location of a laterally extending member, wherein a lateral control member attachment point of the laterally extending member is located horizontally and laterally from a pivot hinge assembled to the mast, wherein the lateral control members are lines, wherein each laterally extending member is pivotally assembled to a base portion of the mast.

In yet another aspect, the method further comprising a step of securing a port and a starboard lateral control member to respective sides of the mast and a location of the deck laterally positioned from the mast, wherein the lateral control members are lines.

In yet another aspect, the method further comprising a step of using the lateral control members to maintain lateral control of the mast during the raising/lowering of the mast.

In yet another aspect, the method further comprising a step of securing a second line between an upper region of the mast and a bow region of the sailboat.

In yet another aspect, the method further comprising a step of securing a second line between an upper region of the mast and a bow region of the sailboat, wherein the second line is a forestay.

In yet another aspect, the method further comprising a step of securing a second line between an upper region of the mast and a bow region of the sailboat, wherein the second line is an inner forestay.

In yet another aspect, the method further comprising a step of securing a second line between an upper region of the mast and a bow region of the sailboat, wherein the second line is a cutter stay.

In yet another aspect, the method further comprising a step of securing a second line between an upper region of the mast and a bow region of the sailboat, wherein the second line is a jib stay.

In yet another aspect, the method further comprising a step of disconnecting the mast control line and the winch cable following the step of securing the second line between the upper region of the mast and the bow region of the sailboat.

In yet another aspect, the method further comprising steps of releasing a tension in the winch cable and disconnecting the mast control line and the winch cable following the step of securing the second line between the upper region of the mast and the bow region of the sailboat.

In yet another aspect, the method further comprising a step of launching the sailboat with the upright, secured mast.

In accordance with the present invention, a method for lowering a mast on a sailboat, the method comprising steps of:

- adjusting a height of a height adjustable column to a desired height;
- routing a free end of a winch cable through a cable direction changing member secured to a top region of the height adjustable column and securing the free end of the winch cable to a mast control line;
- collecting a portion of the winch cable onto a drum until the winch cable is taught;
- disconnecting all forward mast supporting lines;
- unspooling the winch cable from the drum causing the mast to pivot about a mast pivot hinge from an upright orientation to a substantially horizontal orientation;
- seating the mast in a mast clutch; and
- securing the mast in a transport orientation.

In yet another aspect, the method further comprising a step of separating the mast and the mast pivot assembly from one another.

In yet another aspect, the method further comprising a step of disconnecting the free end of the winch cable and a mast control line from one another.

In yet another aspect, the method further comprising a step of positioning the mast within the mast clutch for transport.

In yet another aspect, the method further comprising a step of positioning a first end of the mast within the mast clutch and a second, opposite end of the mast against a bow pulpit for transport.

In yet another aspect, the method further comprising a step of securing the first end of the mast within the mast clutch.

In yet another aspect, the method further comprising a step of securing the second, opposite end of the mast against a bow pulpit for transport.

These and other aspects, features, and advantages of the present invention will become more readily apparent from the attached drawings and the detailed description of the preferred embodiments, which follow.

BRIEF DESCRIPTION OF THE DRAWINGS

Variants of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION OF THE PRESENT INVENTION

Figure 1:
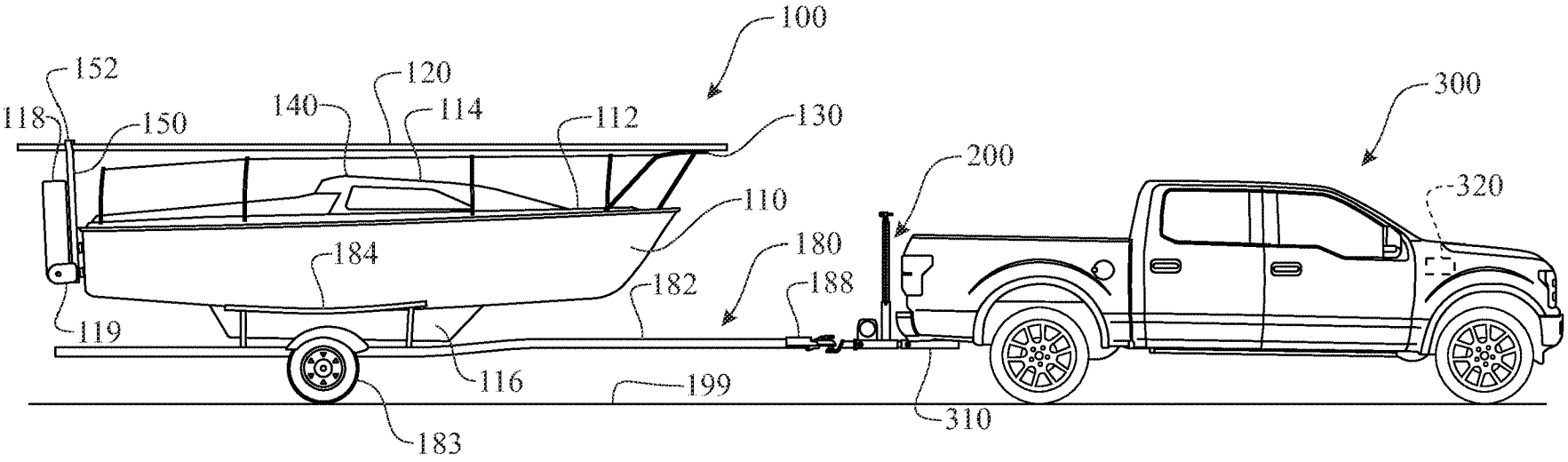
FIG. 1 presents a side, elevation view of an exemplary sailboat loaded upon a trailer, the trailer being coupled to a trailer hitch assembly supported by a mast pivotal orientation assembly, wherein the mast pivotal orientation assembly is slideably assembled to a trailer hitch receiver of a vehicle.
Figure 2:
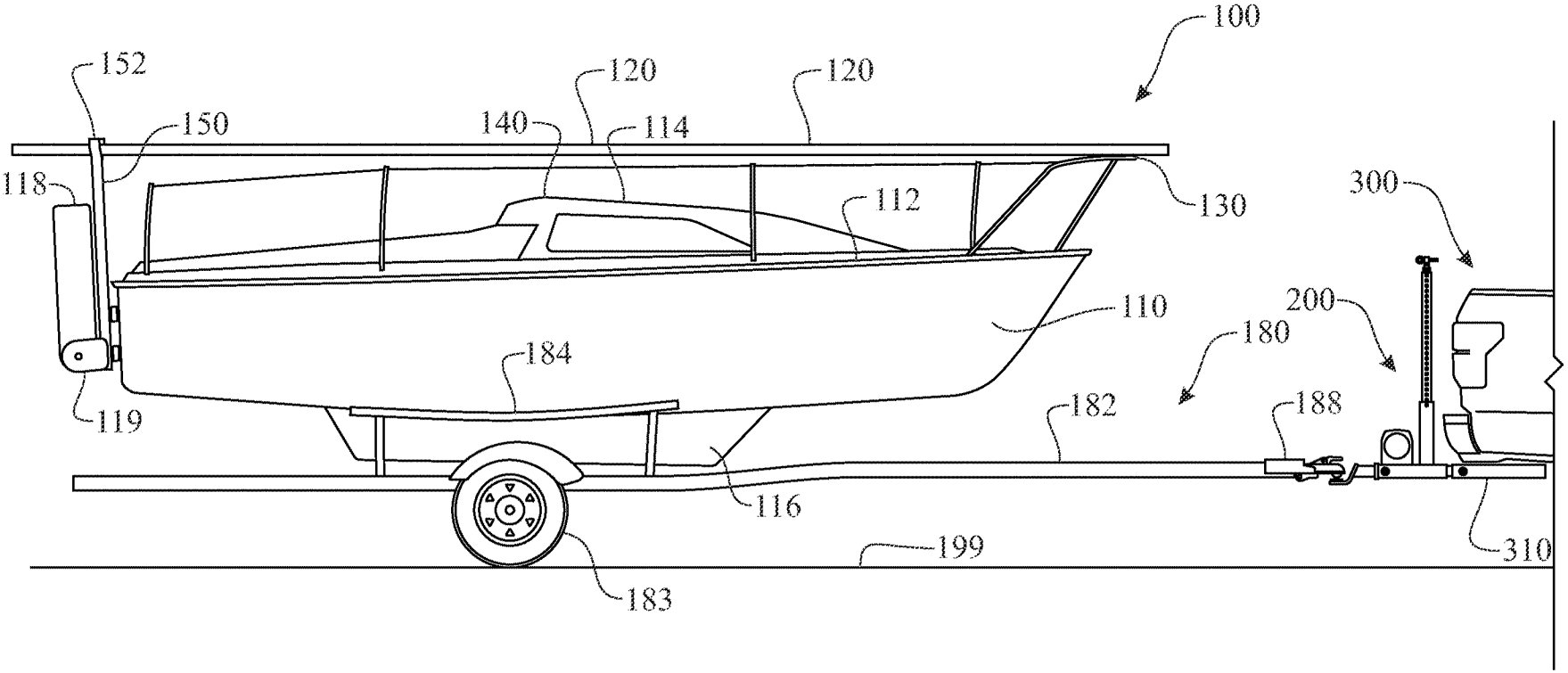
FIG. 2 presents an enlarged side, elevation view of the exemplary sailboat loaded upon the trailer, as originally illustrated in FIG. 1.

Sailboats 100 are designed and built in all sizes, with the present invention being directed towards sailboats 100 that are transported on a trailer 180, as illustrated in FIGS. 1 and 2. The trailer 180 is being towed by a vehicle 300. The sailboat 100 includes a bulwark 114 defined by a structure extending upward from a deck 112, the deck 112 and bulwark 114 being assembled to an upper region of a hull 110. A bow pulpit 130 is preferably secured to a bow region of the sailboat 100. Handrails supported by a series of pillars (illustrated but not identified) are provided around a perimeter of the sailboat 100 to enable safe passage of the crew from the stern to the bow and vice versa. A keel 116 extends downward from a lower portion of the hull 110. The keel 116 is designed to stabilize the sailboat 100 against a force generated by wind against a sail while underway.

Masts 120 of sailboats 100 sized to be transported on the trailer 180 are commonly designed to be raised (stepped) and lowered (unstepped) for transporting of the sailboat 100. The mast is typically hollow, having a mast interior wall 122, to obtain a desired strength while minimizing a weight. A mast pivot assembly 140 is provided to aid in stepping and unstepping the mast 120 of the sailboat 100. The mast pivot assembly 140 can be of any known design that aids in rotating the mast 120 from an upright orientation to a lowered, generally horizontal orientation. An exemplary mast pivot assembly 140 is detailed in the illustrations presented in FIGS. 11 and 12. The exemplary mast pivot assembly 140 includes a pivot to mast assembly feature 146 carried by a mast pivot hinge arm 144. The mast pivot hinge arm 144 and a mast receiving base feature 148 are pivotally assembled to one another by a mast pivot hinge 142. The pivot to mast assembly feature 146 is temporarily assembled to the mast 120 using any known temporary assembly interface. In the exemplary illustration, the pivot to mast assembly feature 146 is slideably inserted into a receiving slot located proximate a base of the mast 120. The mast receiving base feature 148 extends proud of the upper surface of the bulwark 114 and is of a size and shape to be inserted into the interior of the mast 120 and seated against the mast interior wall 122. The mast receiving base feature 148 retains the base of the mast 120 from any longitudinal and/or lateral movements while the rigging retains the mast upright and properly seated about the mast receiving base feature 148. The mast pivot assembly 140 is only exemplary and sailboats 100 have many different designs and mechanics that enable the same function thereof.

The mast 120 is secured in a generally horizontal orientation enabling transportation of the sailboat 100 on a trailer 180. A first end of the trailer 180 is seated within a mast support crutch 152 of a mast support column 150. A second, opposite end of the trailer 180 is seated onto the bow pulpit 130 directly, within a clutch supported by or proximate to the trailer 180 of the sailboat 100, or within a forward crutch extending upward from a forward portion of the trailer frame 182 of the trailer 180. The mast support column 150 can be secured to the sailboat 100, as illustrated or to the trailer 180. The exemplary mast support column 150 is integrated into a rudder assembly, which includes a rudder 118 rotationally and pivotally assembled to the sailboat 100 by a rudder stowage pivot support 119. A pivot axle enables vertical rotation of the rudder 118 between a steering position and a stowage position (as illustrated). The mast support column 150 extends upward from the rudder assembly. The mast support column 150 can be removable for storage during sailing. The mast support crutch 152 is supported at an upper end of the mast support column 150.

The sailboat 100 can be transported upon a trailer 180. The trailer 180 includes a trailer frame 182 comprising a pair of frame members, preferably formed in a "Y" shape. A trailer coupler 188 is assembled to a leading end of the trailer 180. The trailer coupler 188 includes a ball receiver and a ball latching mechanism (including an underjaw, a handle assembly operationally engaging with the underjaw and a spring). At least one trailer wheel 183 is provided at each side of an axel (not illustrated) of the trailer 180. Each trailer bed 184 of a pair of trailer beds 184 is assembled to a respective side of the trailer frame 182 of the trailer 180 by a series of supporting columns (illustrated by not identified).

The hull 110 of the sailboat 100 is seated upon and supported by the pair of trailer beds 184. The trailer beds 184 are of a height and position to provide adequate clearance for the keel 116 of the sailboat 100. A bow support (not illustrated) and an associated winch or other latching or retention mechanism can be provided at a forward position on the trailer 180 to retain the sailboat 100 in position on the trailer 180.

Figure 3:
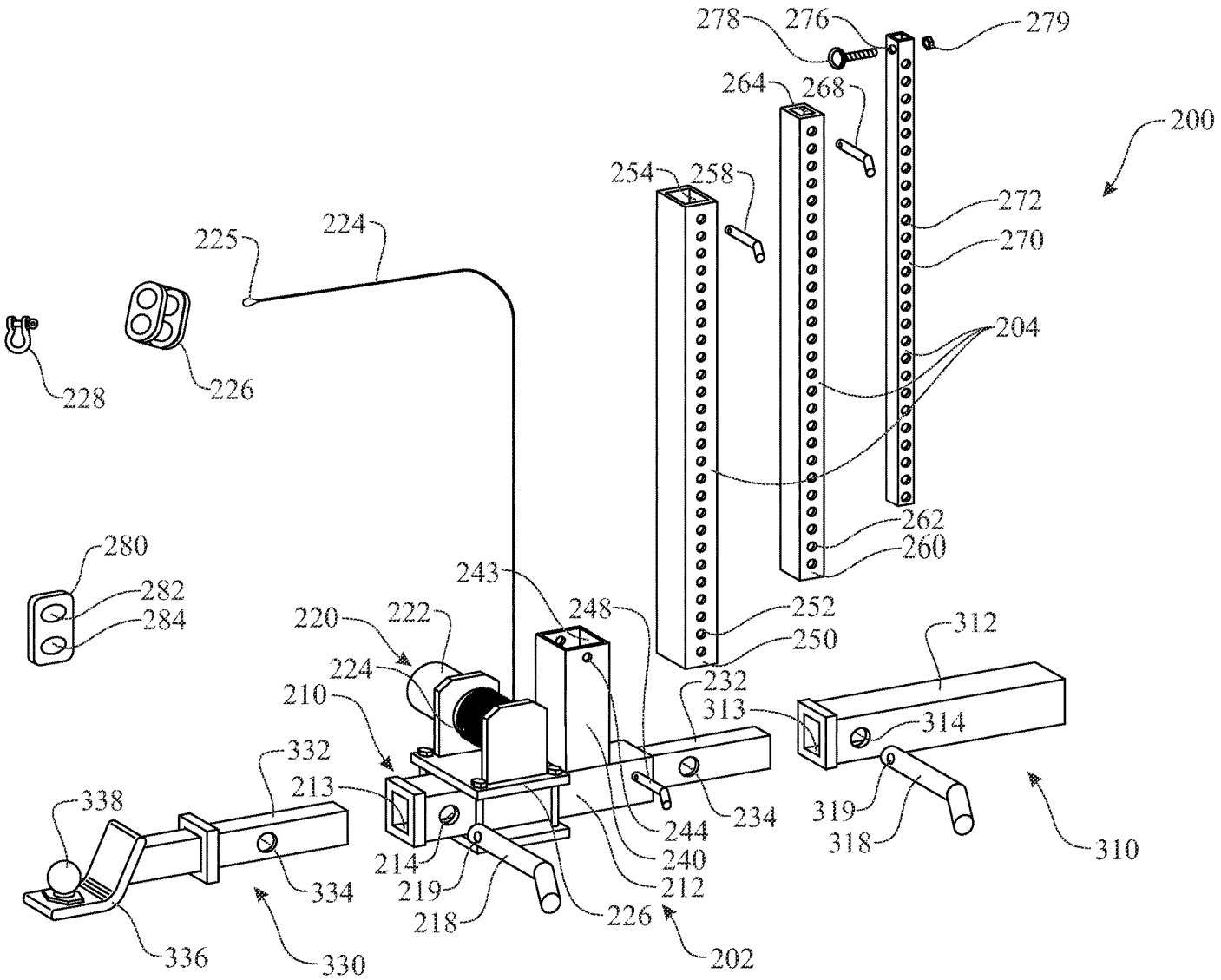
FIG. 3 presents a side top isometric exploded assembly view of the mast pivotal orientation assembly originally introduced in FIG. 1.

A mast righting assistance assembly 200, detailed in an exploded assembly view illustrated in FIG. 3, is introduced to aid a sailing enthusiast in raising and lowering the mast 120 of the sailboat 100. The mast righting assistance assembly 200 includes a mast righting assistance column subassembly 204 preferably designed to be detachably assembled to a mast righting assistance operational subassembly 202. The mast righting assistance operational subassembly 202 is designed to be inserted between a vehicle hitch receiver assembly 310 (integral with the vehicle 300) and a trailer hitch assembly 330. A trailer hitch extension subassembly 210 includes a trailer hitch extension receiver tube 212 at a first end and a trailer hitch extension insert 232 at a second end. The trailer hitch extension insert 232 is of a size and shape to be inserted into and supported by a receiver defined by a vehicle hitch receiver tubular interior wall 313 of a vehicle hitch receiver tube 312 of the vehicle hitch receiver assembly 310. A vehicle hitch receiver locking member 318 is inserted through a vehicle hitch receiver locking aperture 314 of the vehicle hitch receiver tube 312, passing through of trailer hitch extension insert locking aperture 234 of the inserted trailer hitch extension insert 232. A vehicle hitch receiver locking member retention aperture 319 formed through the vehicle hitch receiver locking member 318 is exposed on an opposing side of the vehicle hitch receiver tube 312, where a retention member is inserted through the vehicle hitch receiver locking member retention aperture 319, thus retaining the vehicle hitch receiver locking member 318 in position to ensure and maintain assembly of the trailer hitch extension insert 232 (thus the mast righting assistance operational subassembly 202) to the vehicle hitch receiver assembly 310. The retention member can be a locking pin, a hairpin, a lock, or any other suitable element.

Similarly, a trailer hitch insert 332 of the trailer hitch assembly 330 is of a size and shape to be inserted into and supported by a receiver defined by a trailer hitch extension receiver tubular interior wall 213 of a trailer hitch extension receiver tube 212 of the trailer hitch extension subassembly 210. A trailer hitch extension receiver locking member 218 is inserted through a trailer hitch extension receiver locking aperture 214 of the trailer hitch extension receiver tube 212, passing through the trailer hitch insert locking aperture 334 of the trailer hitch insert 332. A trailer hitch extension receiver locking member retention aperture 219 formed through the trailer hitch extension receiver locking member 218 is exposed on an opposing side of the trailer hitch extension receiver tube 212, where a retention member is inserted through the trailer hitch extension receiver locking member retention aperture 219, thus retaining the trailer hitch extension receiver locking member 218 in position to ensure and maintain assembly of the trailer hitch insert 332 (thus the trailer hitch assembly 330) to the trailer hitch extension subassembly 210. The trailer hitch assembly 330 additionally includes a trailer hitch ball mount 336 provided at an exposed end of the trailer hitch insert 332. A trailer hitch ball 338 is carried by the trailer hitch ball mount 336. In a common arrangement, a threaded post of the trailer hitch ball 338 is inserted through an aperture and secured to the trailer hitch ball mount 336 by a nut threadably assembled to the threaded post of the trailer hitch ball 338.

A winch subassembly 220 is carried by the trailer hitch extension subassembly 210. The winch subassembly 220 includes a winch motor 222 which controls rotation of a drum; the drum being designed to collect and dispense a length of a cable 224. The cable 224 can be a rope, a braided rope, a wire cable, a braided cable, a steel core cable, or any other suitable, flexible tension applying member. A winch cable free end loop 225 is preferably provided at a free end of the cable 224 enabling connection of the cable 224 to other objects. The winch subassembly 220 can be assembled to the trailer hitch extension subassembly 210 in any suitable orientation. The winch subassembly 220 can be assembled to the trailer hitch extension subassembly 210 using any suitable assembly interface. In the exemplary illustration, the winch subassembly 220 includes a block 226, which includes through holes for receiving threaded assembly members, such as threaded bolts (illustrated but not identified). The threaded members can be secured using nuts, washers, locking washers, and/or any other elements commonly used for mechanically fastening one element to a second element. In one alterative arrangement, the winch subassembly 220 can be secured to the trailer hitch extension subassembly 210 using one or more brackets forming a mechanical assembly. In another alterative arrangement, the winch subassembly 220 can be secured to the trailer hitch extension subassembly 210 using a welding process. In yet another alterative arrangement, the winch subassembly 220 can be secured to the trailer hitch extension subassembly 210 using one or more straps. In yet another alterative arrangement, the winch subassembly 220 can be secured to the trailer hitch extension subassembly 210 using any combination of the above described assembly methods or any other suitable assembly method. A fairlead (not illustrated but well known by those skilled in the art) can be included in the mast righting assistance operational subassembly 202, wherein the fairlead is located to aid in proper collection and dispensing of the cable 224 to and from the drum of the winch subassembly 220. The winch subassembly 220 can be operated by a winch controller 280. The winch controller 280 can be wired or wireless. The winch controller 280 preferably includes a winch controller collection button 282 to actuate a drum rotation to collect a length of the winch cable 224 and a winch controller dispense button 284 to actuate a drum rotation to unspool a length of the winch cable 224.

Other components included in the mast righting assistance assembly 200 include a block 226 and a shackle 228. The block 226 is representative of any cable redirecting component. The shackle 228 is representative of any joining component.

A column subassembly receiver 240 is assembled to the trailer hitch extension subassembly 210. In the exemplary illustration, the column subassembly receiver 240 is welded to an upper surface of the trailer hitch extension subassembly 210. The column subassembly receiver 240 can be secured to the trailer hitch extension subassembly 210 at any suitable location, including on the top surface (as illustrated), on one or both sides of the trailer hitch extension subassembly 210, to a bracket carried by the trailer hitch extension subassembly 210, or any other suitable arrangement. The column subassembly receiver 240 can be secured to the trailer hitch extension subassembly 210 using any suitable attachment interface, including welding, use of fasteners, use of mechanical fasteners, use of threaded fasteners, use of one or more brackets, a mechanical loop that extends partially or completely around the trailer hitch extension subassembly 210, or any other suitable assembly method.

The column subassembly receiver 240 is designed to receive and support the mast righting assistance column subassembly 204. In the exemplary illustration, the column subassembly receiver 240 includes a cavity defined by a column subassembly receiver tubular interior wall 243, wherein the cavity is of a size and shape to receive and adequately support a base end of a base column member 250 of the mast righting assistance column subassembly 204.

The exemplary mast righting assistance column subassembly 204 includes a base column member 250, a central column member 260 and an upper column member 270. The exemplary base column member 250 is a tubular member comprising a series of base column member adjustment apertures 252 spatially arranged through opposing walls of the base column member 250. The exemplary central column member 260 is a tubular member comprising a series of central column member adjustment apertures 262 spatially arranged through opposing walls of the central column member 260. An exterior of the central column member 260 is of a size and shape to be inserted into and adequately supported by a base column member tubular interior wall 254 of the base column member 250. The exemplary upper column member 270 is a tubular member comprising a series of upper column member adjustment apertures 272 spatially arranged through opposing walls of the upper column member 270. An exterior of the upper column member 270 is of a size and shape to be inserted into and adequately supported by a central column member tubular interior wall 264 of the central column member 260. In the exemplary mast righting assistance column subassembly 204, a threaded elongated member of a block attachment member 278 is inserted through a upper column member block attachment aperture 276 formed through opposite walls of the upper column member 270 and secured in position by threadably assembling a block attachment member nut 279 to the threaded elongated member of the block attachment member 278. The upper column member 270 can be tubular, similar to the other column members 250, 260, the upper column member 270 having an upper column member tubular interior wall 274.

Figure 4:
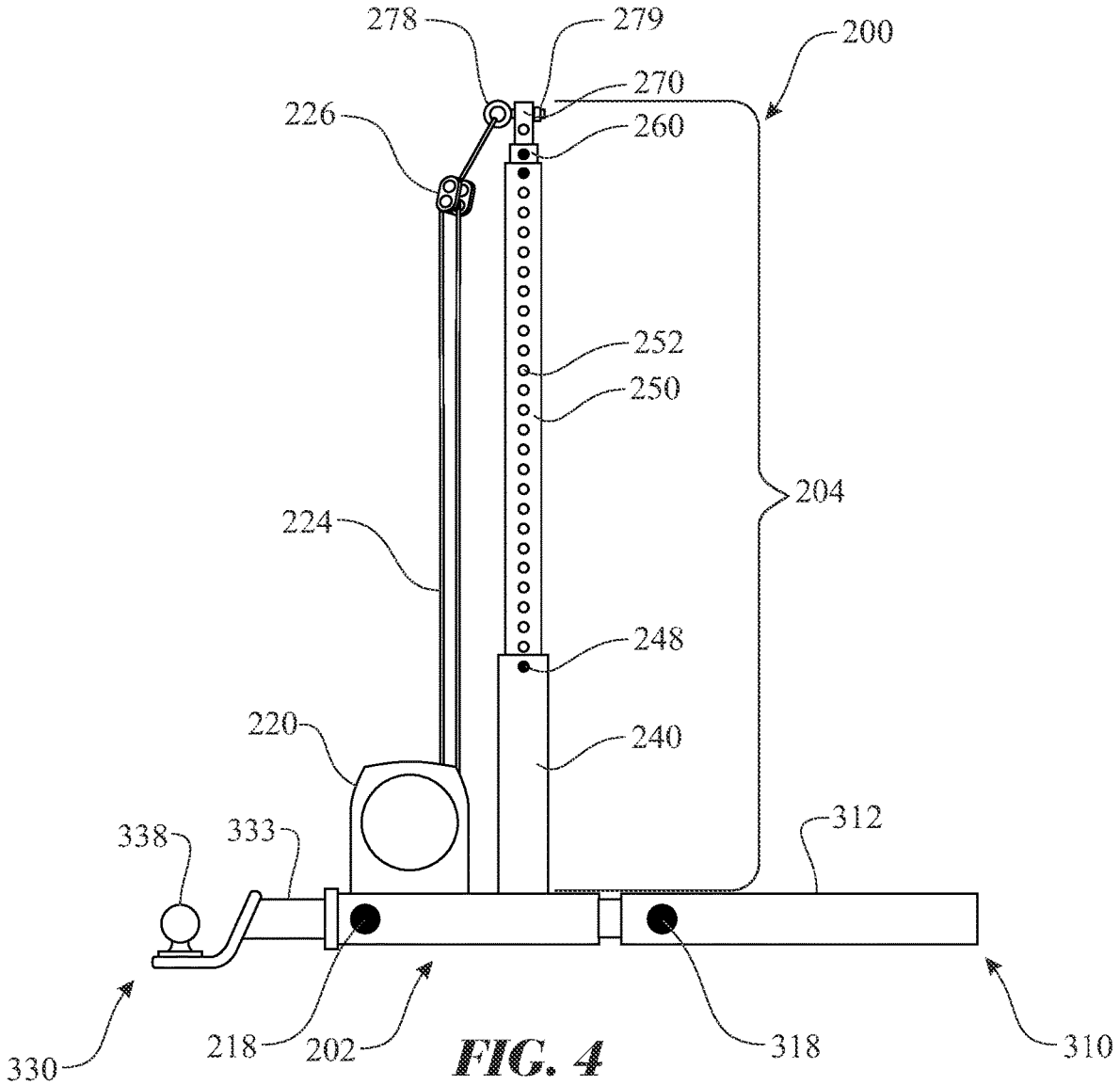
FIG. 4 presents a side elevation view of the mast pivotal orientation assembly originally introduced in FIG. 1, the illustration presenting the mast pivotal orientation assembly in a compact configuration.
Figure 5:
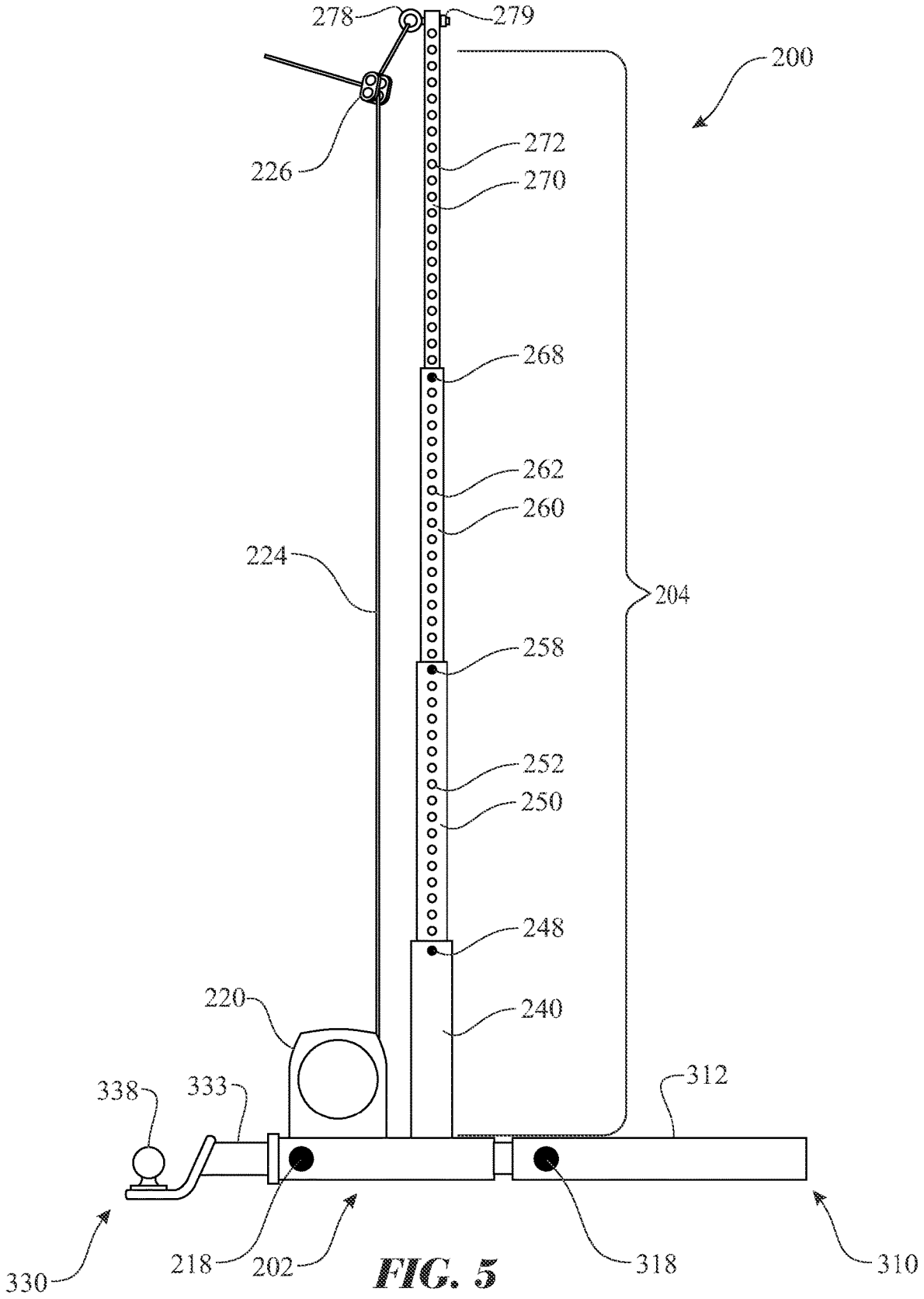
FIG. 5 presents a side elevation view of the mast pivotal orientation assembly originally introduced in FIG. 1, the illustration presenting the mast pivotal orientation assembly in a fully extended configuration.

Details of a height adjustability of the mast righting assistance column subassembly 204 are demonstrated the illustrations presented in FIGS. 4 and 5. In the exemplary illustrations, a base of the base column member 250 is inserted into the interior (defined by the column subassembly receiver tubular interior wall 243) of the column subassembly receiver 240. A column subassembly receiver locking member 248 is inserted through a column subassembly receiver locking aperture 244 and an associated aperture 252 formed through the sidewall of the base column member 250, supporting the base column member 250 at a desired height. The central column member 260 is slideably inserted into an interior of the base column member 250 defined by the base column member tubular interior wall 254. The upper column member 270 is slideably inserted into an interior of the central column member 260 defined by the central column member tubular interior wall 264. The height of each of the central column member 260 and the upper column member 270 are adjusted to position the block attachment member 278 at a desired height. As each of the central column member 260 and the upper column member 270 are at their desired position (height), a column height locking member 258, 268 is inserted through a respective base column member adjustment apertures 252 262 to retain the column members 250, 260, 270 at the desired vertical positions. Although the exemplary illustrations and associated disclosure describes a mast righting assistance column subassembly 204 having a specific arrangement, the mast righting assistance column subassembly 204 can be any arrangement allowing vertical adjustment of the block attachment member 278. This can include a telescoping design, a ratcheting assembly, a hydraulically height adjusting assembly, a pneumatically height adjusting assembly, a series of members that are assembled to one another to adjust an overall height, a substantially tall member that provides a maximum height to achieve a minimum desired angle of tension, a scissor styled assembly, or any other height adjustable design. The mast righting assistance column subassembly 204 would be designed to sufficiently support the forces required (including any factor of safety) to raise and lower the mast 120 of the sailboat 100.

At some point during the staging of the mast righting assistance assembly 200, a block 226 is secured to the block attachment member 278. The block 226 can be secured to the block attachment member 278 using any suitable attachment member or members. In one example, a carabineer is secured to each of the block 226 and the block attachment member 278, supporting the block 226 at a desired height. In a second example, a cable is used to secure the block 226 and the block attachment member 278 to one another, supporting the block 226 at the desired height. Although several examples of attachment configurations are described herein, any attachment configuration can be any suitable configuration capable of adequately supporting the block 226 by the mast righting assistance column subassembly 204.

Figure 11:
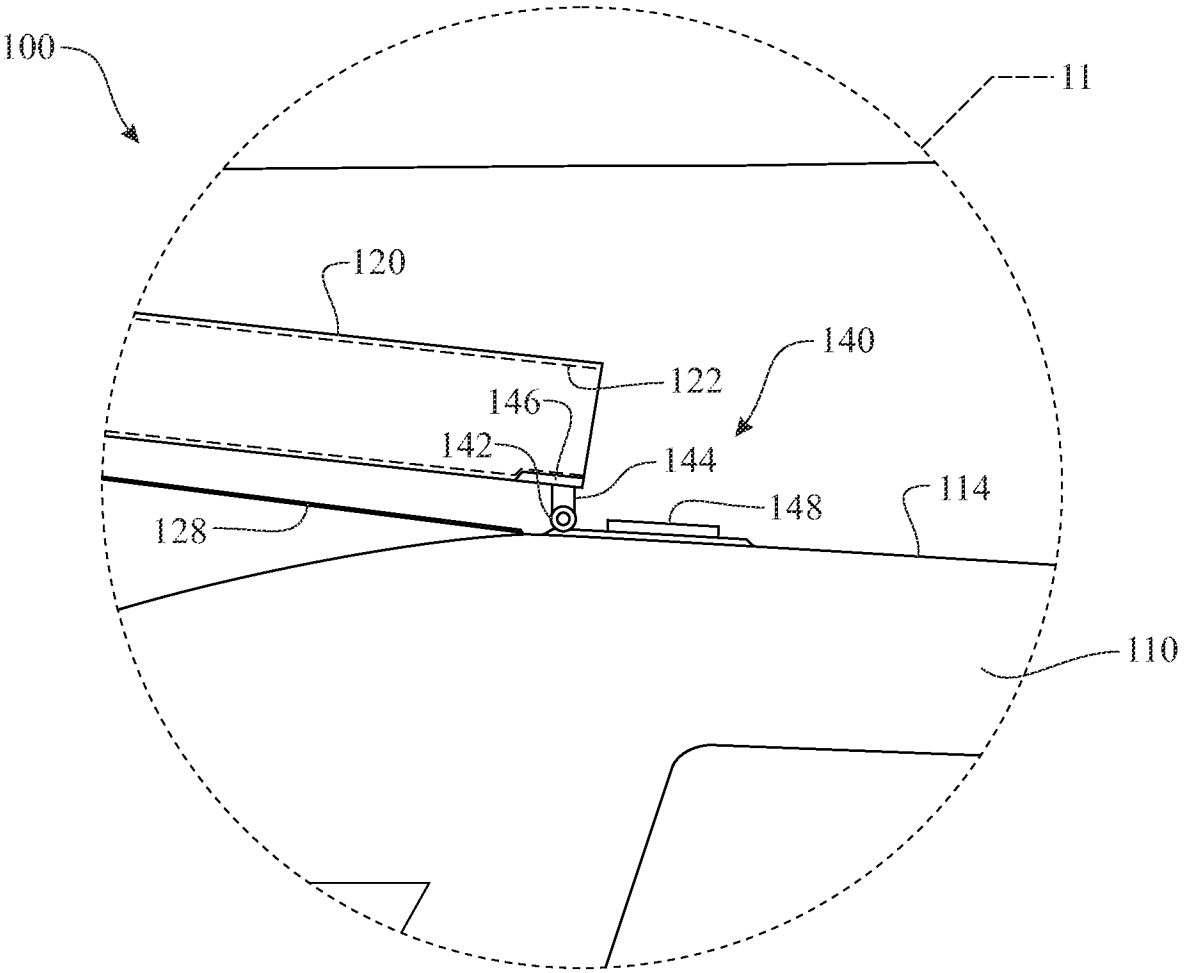
FIG. 11 presents an enlarged side elevation view of a mast pivot assembly, the section taken within section line 11 of FIG. 6, wherein mast is illustrated in a lowered, transportation orientation.
Figure 12:
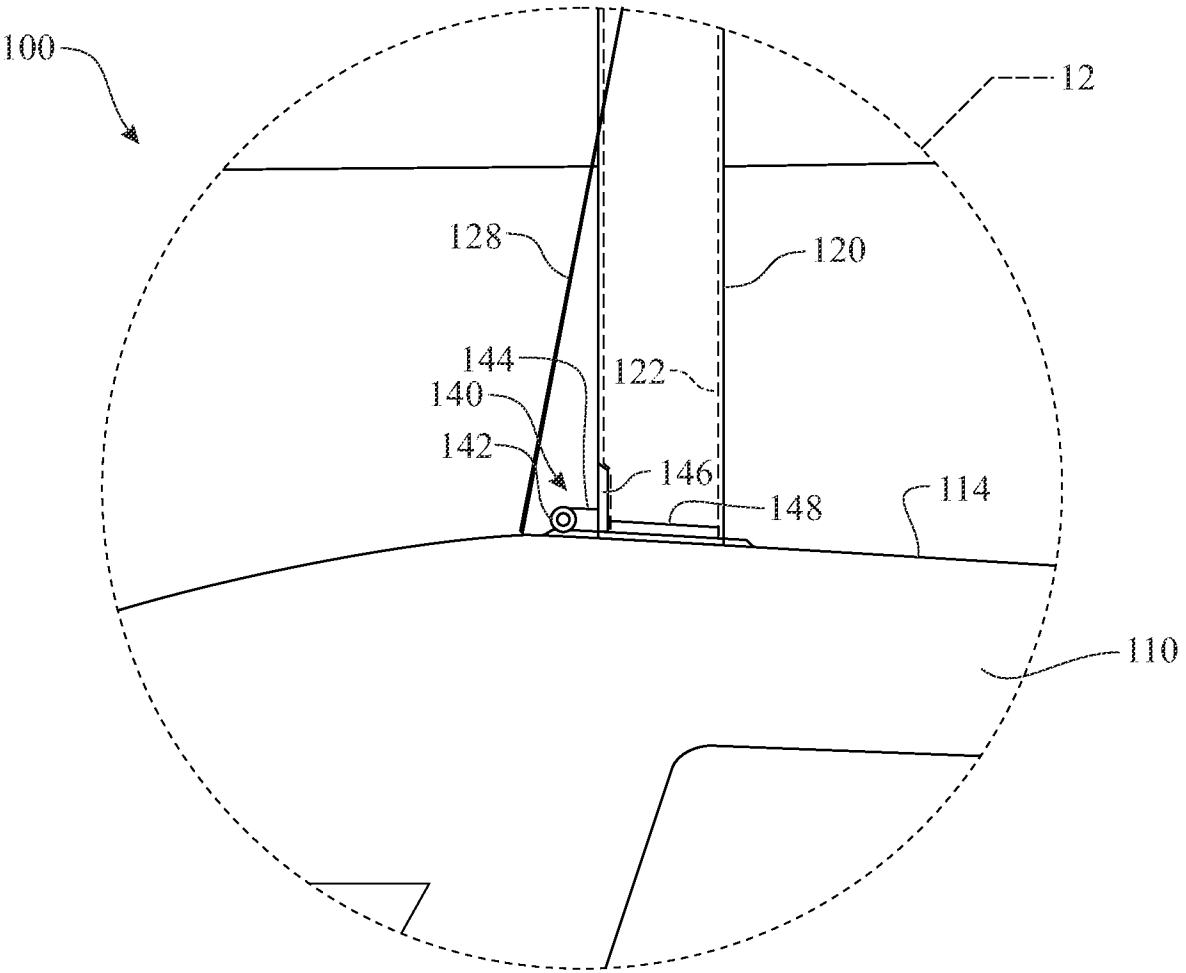
FIG. 12 presents an enlarged side elevation view of the mast pivot assembly, the section taken within section line 12 of FIG. 8, wherein mast is illustrated in an upright, sailing orientation.
Figure 13:
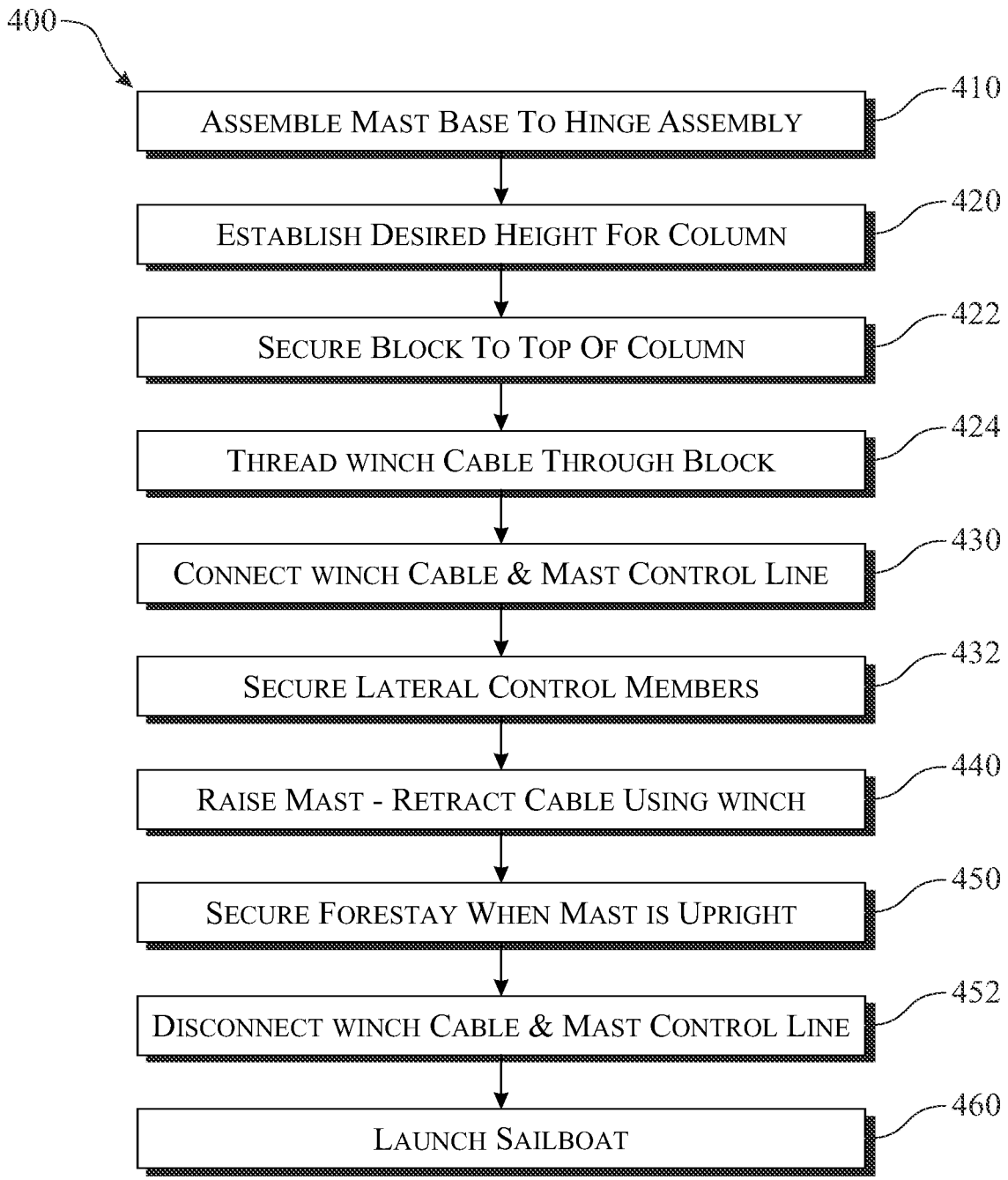
FIG. 13 presents an exemplary flow diagram outlining steps for raising a mast of a sailboat from a transportation orientation to a sailing orientation.
Figure 14:
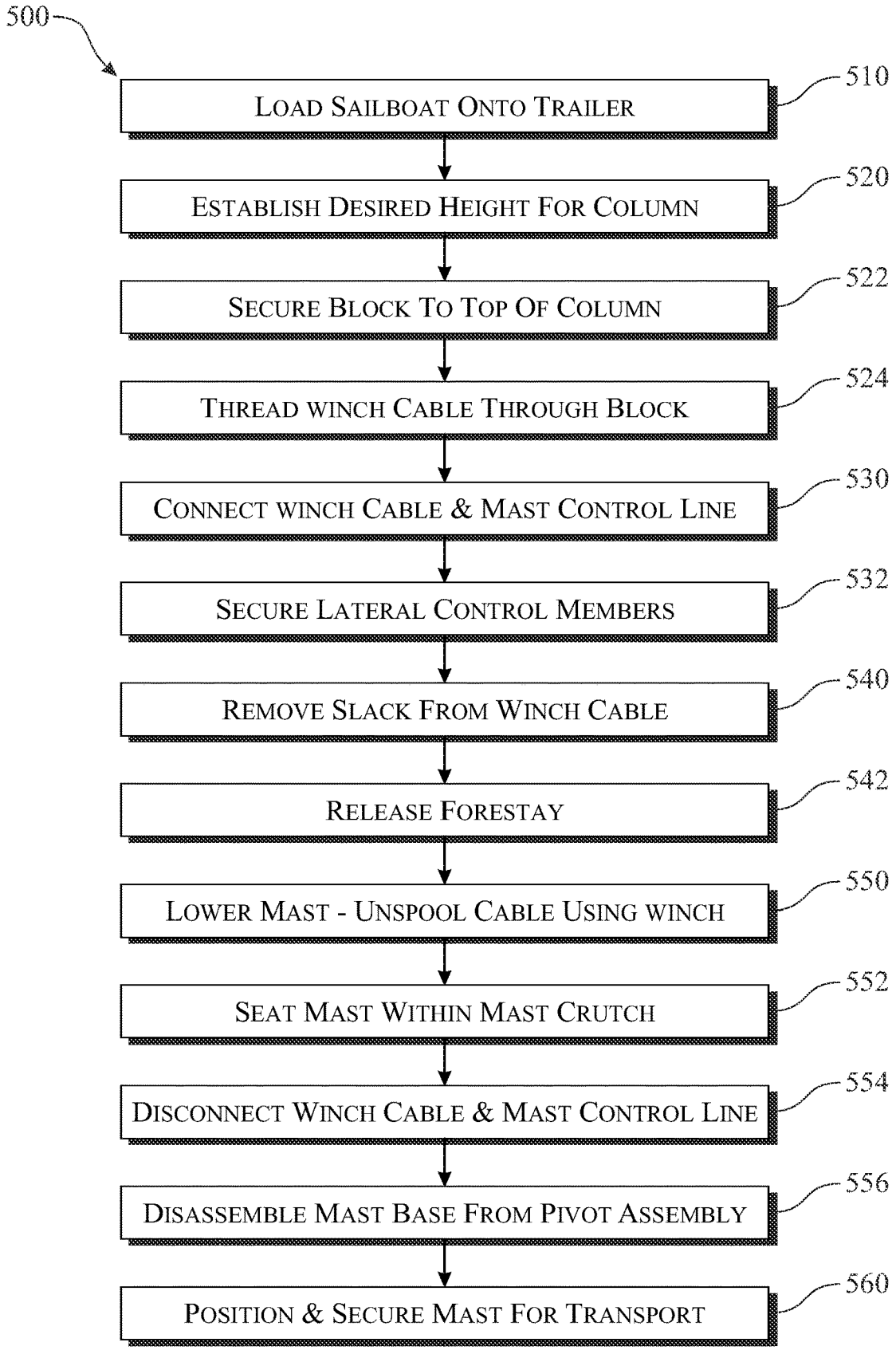
FIG. 14 presents an exemplary flow diagram outlining steps for lowering a mast of a sailboat from a sailing orientation to a transportation orientation.

Operation of the present invention is described in an exemplary mast raising flow diagram 400 detailed in FIG. 13, with supporting illustrations presented in FIGS. 6 through 12 and an exemplary reverse process described in a mast lowering flow diagram 500 being detailed in FIG. 14.

Prior to raising the mast 120, the user would remove any devices (such as straps) that are currently retaining the mast 120 in a stowed position. The exemplary mast raising flow diagram 400 initiates with a step of assembling the mast 120 to the mast pivot assembly 140 (block 410), as illustrated in FIGS. 11 and 12. In the exemplary illustration, the pivot to mast assembly feature 146 of the mast pivot assembly 140 is slideably inserted into a receiving formation provided along a respective sidewall at a base of the mast 120. Each sailboat 100 designer may select a uniquely designed mast pivot assembly 140. Each mast design may employ a distinct arrangement for joining the base of the mast 120 and the selected mast pivot assembly 140 to one another. The key feature of the selected mast pivot assembly 140 is an ability to pivot the mast 120 between adown position and an upright position.

The mast righting assistance column subassembly 204 is assembled to the column subassembly receiver 240 of the trailer hitch extension subassembly 210. A height of the mast righting assistance column subassembly 204 is adjusted to a desired height (block 420). The block 226 is assembled to an upper end of the mast righting assistance column subassembly 204 using the provided attachment component(s) (block 422). Although the assembly of the block 226 to the mast righting assistance column subassembly 204 is described following the step of adjusting a height of the mast righting assistance column subassembly 204, the order of these steps is not defined. At any point during the staging portion of the process, the winch cable 224 is threaded through the block 226 (block 424). At any point during the staging process, a power connector of the winch subassembly 220 may be connected to a mating power connector integrated into a vehicle power system which obtains power from a battery 320 within the vehicle 300.

Upon completion of the staging of the mast righting assistance assembly 200, the winch cable 224 is connected to a mast control line 126 (block 430). The mast control line 126 is preferably any fore mast rigging that can be disconnected without destabilizing the mast 120. Alternatively, a specific line can be secured to an upper region of the mast 120 and used as the mast control line 126. A shackle 228 (or any other suitable connecting component) can be employed to join the mast control line 126 and the winch cable 224 to one another (block 430).

While preparing the mast 120 for repositioning, a lateral control system 128 is preferably installed (block 432). In the exemplary illustrations, a pair of lateral motion control members 128 are installed; one end of each lateral motion control member 128 is secured to an upper region of the mast 120 and a second, opposite end of the lateral motion control member 128 is secured to the sailboat 100 at a location that is in lateral alignment with the mast 120 (more specifically, the mast pivot hinge 142 of the mast pivot assembly 140) and preferably in horizontal alignment with the mast pivot hinge 142 of the mast pivot assembly 140 (block 432).

Figure 6:
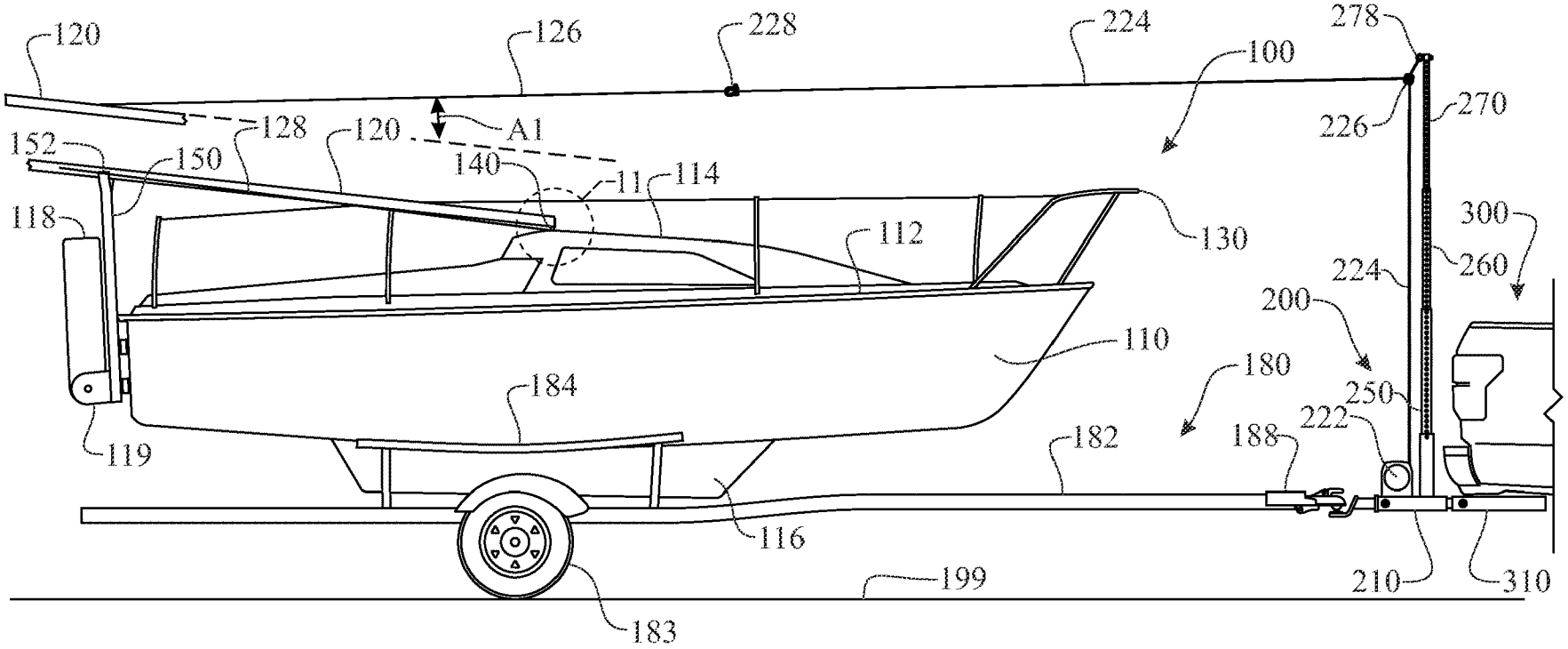
FIG. 6 presents an enlarged side, elevation view of the exemplary sailboat loaded upon the trailer, as originally illustrated in FIG. 1, wherein the mast pivotal orientation assembly is staged for raising the mast.
Figure 7:
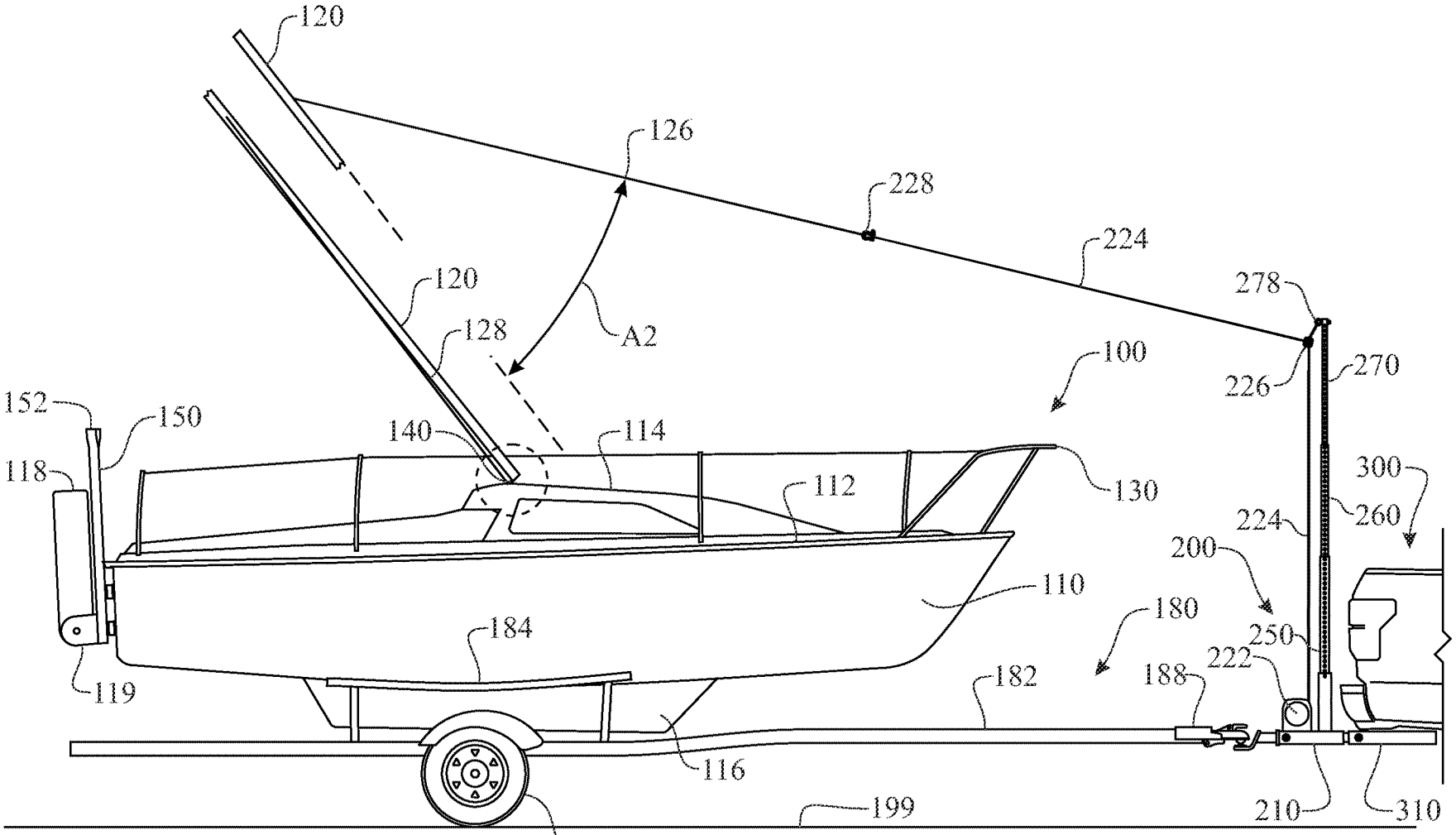
FIG. 7 presents an enlarged side, elevation view of the exemplary sailboat loaded upon the trailer, as originally illustrated in FIG. 1, wherein the mast pivotal orientation assembly has partially raised the mast.
Figure 8:
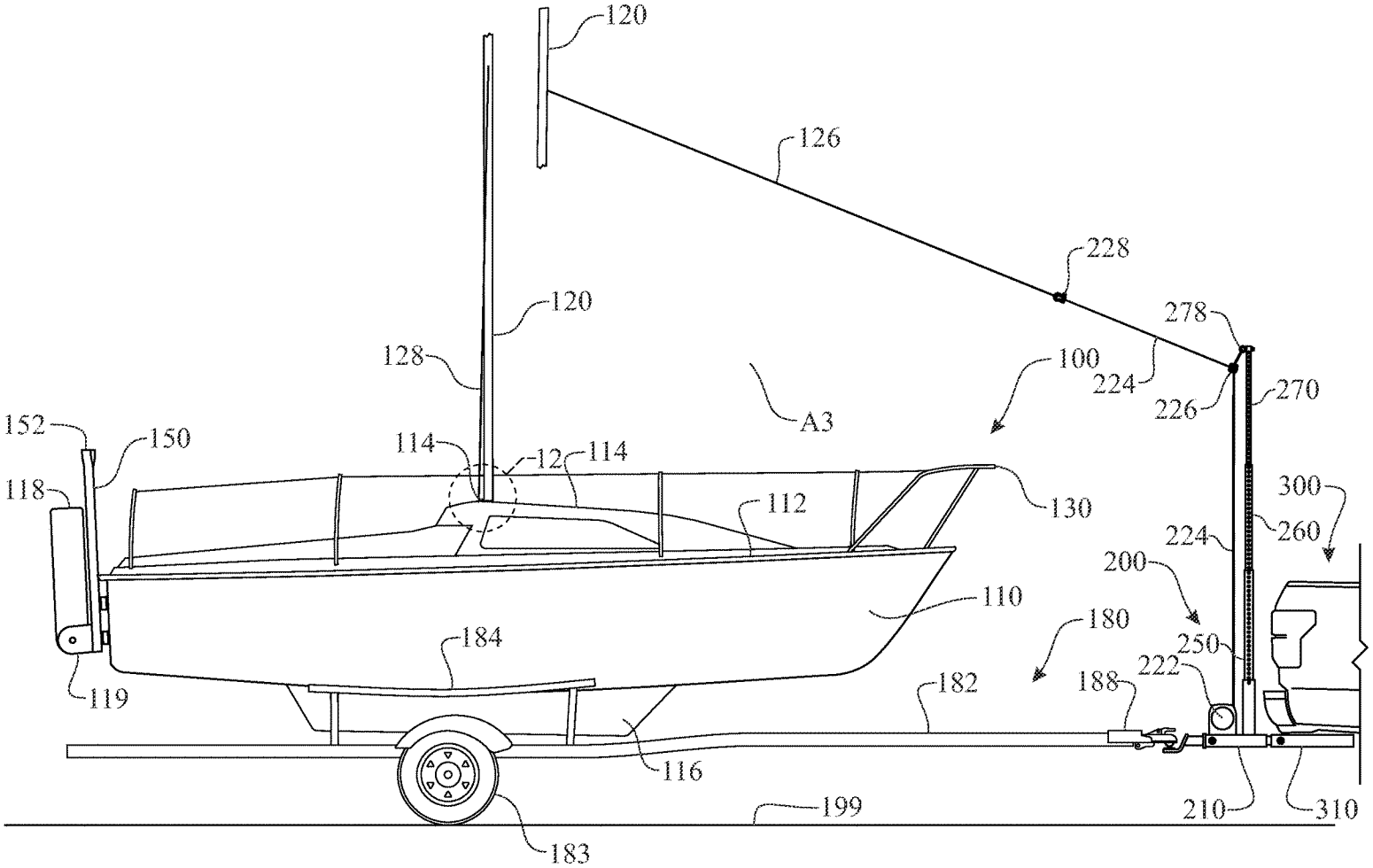
FIG. 8 presents an enlarged side, elevation view of the exemplary sailboat loaded upon the trailer, as originally illustrated in FIG. 1, wherein the mast pivotal orientation assembly has raised the mast to a fully upright orientation.
Figure 9:
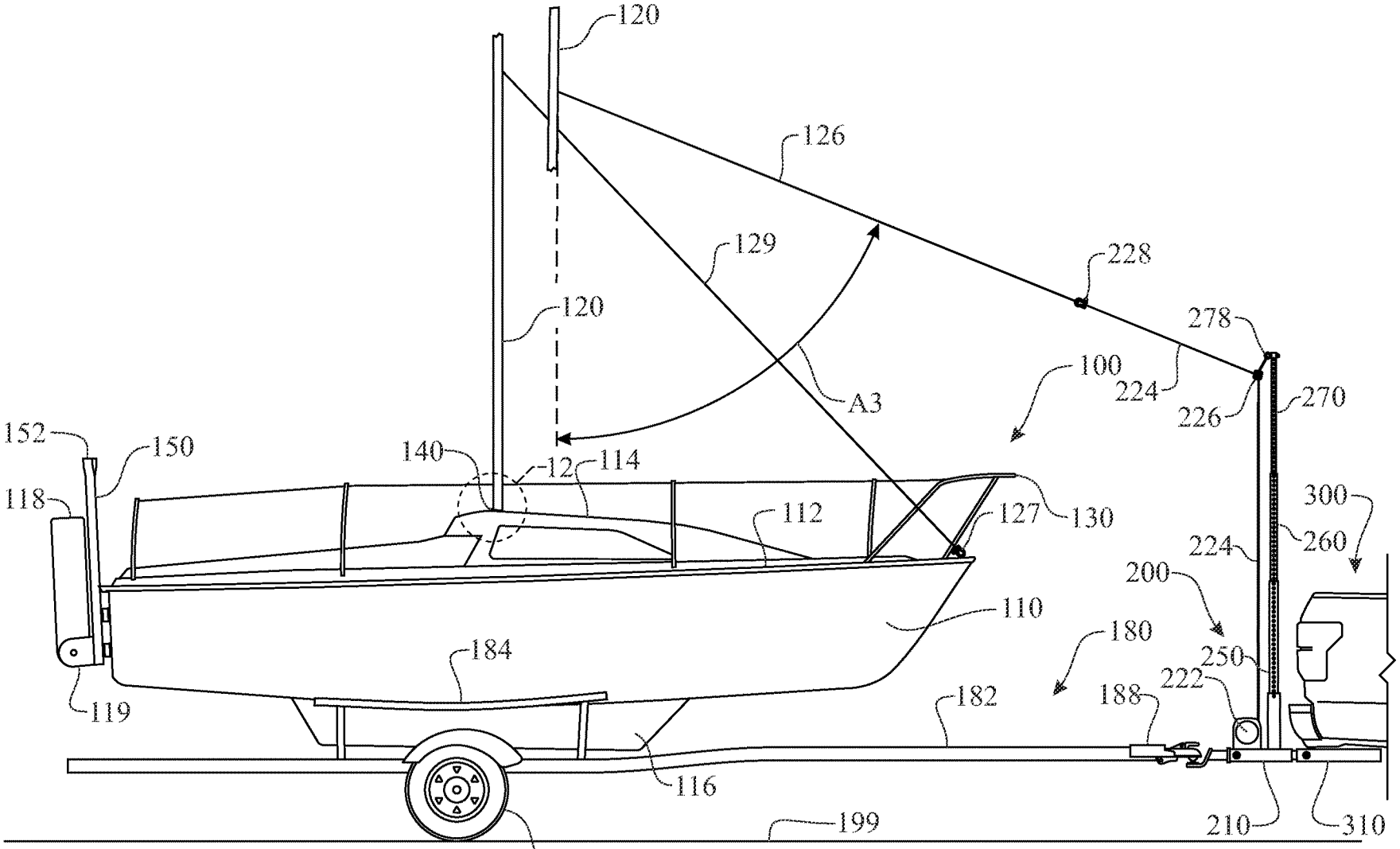
FIG. 9 presents an enlarged side, elevation view of the exemplary sailboat loaded upon the trailer, as originally illustrated in FIG. 1, wherein the mast is in the fully upright orientation and a second line is secured between an upper region of the mast and the bow of the vessel.
Figure 10:
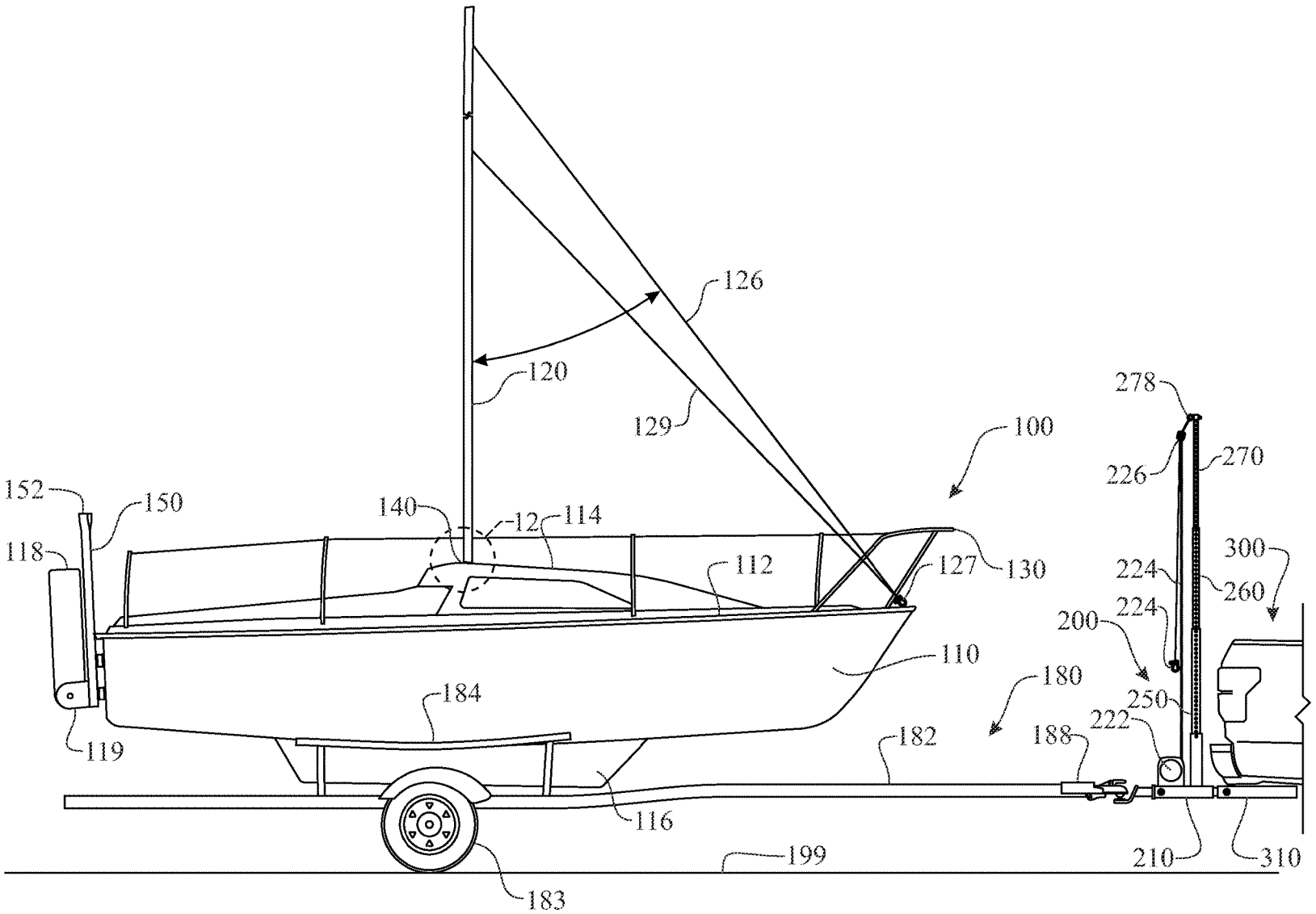
FIG. 10 presents an enlarged side, elevation view of the exemplary sailboat loaded upon the trailer, as originally illustrated in FIG. 1, wherein the mast is in the fully upright orientation, the second line is secured between an upper region of the mast and the bow of the vessel, and the mast control line is disconnected from the winch cable and connected to the bow of the vessel.

The user would then operate the winch subassembly 220, such as by actuating a winch controller collection button 282 on a winch controller 280 to draw in a length of the winch cable 224 or actuating a winch controller dispense button 284 to release a length of the winch cable 224. In the exemplary mast raising flow diagram 400, the user would actuate the winch controller collection button 282 to collect a length of the winch cable 224, causing the mast 120 to rise (block 440). The height of the mast righting assistance column subassembly 204 affects a force application angle respective to stowed mast A1, wherein the force application angle respective to stowed mast A1 is an angle between the mast control line 126 and the mast 120, as illustrated in FIG. 6. The smaller the angle A1, the greater the force required to rotating the mast 120 into an upright orientation. The greater the height of the mast righting assistance column subassembly 204, the greater the force application angle respective to stowed mast A1. The greater the force application angle respective to stowed mast A1, the lower for force required to raise the mast 120. Conversely, the greater the height of the mast righting assistance column subassembly 204, the more difficult it is to transport the mast righting assistance assembly 200. The height adjustment of the mast righting assistance column subassembly 204 optimizing the mast righting assistance column subassembly 204, addressing both concerns. The user would initiate operation of the winch subassembly 220, drawing the mast 120 from a stowed arrangement to an upright arrangement (block 440). The mast initiates in the stowed arrangement (FIG. 6), is drawn to an intermediate orientation having a force application angle respective to partially raised mast A2 (FIG. 7) and upon reaching an upright orientation having a force application angle respective to raised mast A3 (FIG. 8), the operator would cease the collection of winch cable 224 by the winch subassembly 220 by releasing the winch controller collection button 282. The winch cable 224 would remain taught while the operator secures a fore rigging member 129 between the mast 120 and a forestay fitting 127 using a suitable coupling member (block 450), as illustrated in FIG. 9. The fore rigging member 129 can be any rigging line other than the rigging line currently used as the mast control line 126. Upon securing and tightening the fore rigging member 129, tension can be released from the winch cable 224 by depressing the winch controller dispense button 284 on the winch controller 280 to unspool a portion of the winch cable 224 from the drum of the winch subassembly 220. The introduced slack enables the operator to disconnect the mast control line 126 and the winch cable 224 from one another (block 442). The mast control line 126 can be secured to the target attachment member, such as the forestay fitting 127 as illustrated in FIG. 10, or any other target attachment member. The lateral support elements 126 can remain in position or be removed. Any additional preparations can be completed and the sailboat 100 can be launched from the trailer 180 (block 460). Examples of additional preparation can include removing and stowing the mast support column 150, rotating and securing the rudder 118 into a sailing position, and the like.

The mast lowering flow diagram 500 describes a process of lowering the mast 120 from an upright orientation (as illustrated in FIG. 10) into a stowed orientation (as illustrated in FIG. 6). Initially, the sailboat 100 would be placed upon the trailer 180, seating the hull 110 upon the pair of trailer beds 184 (block 510). The rudder 118 would be rotated into a trailed position (as illustrated). A mast support column 150 would be installed according to the designed installation process. A height of the mast righting assistance column subassembly 204 is adjusted to the desired height (block 520), as described above.

The block 226 is assembled to an upper end of the mast righting assistance column subassembly 204 using the provided attachment component(s) (block 522), such as previously described. At any point during the staging portion of the process, the winch cable 224 is threaded through the block 226 (block 524). At any point during the staging process, a power connector of the winch subassembly 220 may be connected to a mating power connector integrated into a vehicle power system. Tension of the mast control line 126 is decreased enabling disconnecting of the mast control line 126 from the forestay fitting 127. The freed mast control line 126 is then connected to the winch cable 224 (block 530). At any point during the preparation of the lowering of the mast 120, the lateral motion control members 128 are installed, as described above (block 532). Any slack is removed from the winch cable 224 by slowly collecting a small length of winch cable 224 upon the drum of the winch subassembly 220 using the winch controller 280 (block 540). Once the mast 120 is supported by the winch cable 224, the other retaining rigging, such as the fore rigging member 129) is loosened and disconnected (block 542).

The operator would inspect the system and sailboat 100 one last time, then once comfortable that the system is properly prepared, the operator would activate the winch controller dispense button 284 of the winch controller 280 and slowly unspool a length of the winch cable 224 from the drum of the winch subassembly 220 (block 550). The unspooling lengthens the winch cable 224, lowering the mast 120 from the upright orientation (FIG. 8) to a lowered orientation (FIG. 6). The height of the mast righting assistance column subassembly 204 defines the force application angle respective to stowed mast A1, wherein the force application angle respective to stowed mast A1 ensures that the winch cable 224 remains in control of the mast 120 throughout the entire lowering process. As the mast 120 is lowered, the mast 120 is guided into the mast support crutch 152 (block 552). Once the mast 120 is seated and adequately supported within the mast support crutch 152, the operator can then disconnect the mast control line 126 and the winch cable 224 from one another by disconnecting the shackle 228 (block 554). The mast 120 is separated from the mast pivot assembly 140 (block 556) by reversing the process described above (block 556). The mast 120 is positioned and secured for transport (block 560).

Although the mast righting assistance assembly 200 is designed for use in stepping and unstepping a mast 120, the mast righting assistance assembly 200 can be adapted for other applications. For example, the mast righting assistance assembly 200 can be used to raise and move logs, seat logs onto a log splitter; provide aid to an accident, such as moving one or more vehicles, move or lift a motorcycle, lift objects off a person, and the like.

Although the exemplary processes described above employ the mast control line 126 secured to the mast 120, the winch cable 224 can be secured to a gin pole.

The mast righting assistance assembly 200 can be assembled to the trailer coupler 188 and supported solely by the ball, thus enabling rotation of the mast righting assistance assembly 200 to further aid in stepping or unstepping of the mast 120.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

ELEMENT DESCRIPTIONS

Ref No. Description

100 sailboat
110 hull
112 deck
114 bulwark
116 keel
118 rudder
119 rudder stowage pivot support
120 mast
122 mast interior wall
126 mast control line
127 forestay fitting
128 lateral motion control member
129 fore rigging member
130 bow pulpit
140 mast pivot assembly
142 mast pivot hinge
144 mast pivot hinge arm
146 pivot to mast assembly feature
148 mast receiving base feature
150 mast support column
152 mast support crutch
180 trailer
182 trailer frame
183 trailer wheel
184 trailer bed
188 trailer coupler
200 mast righting assistance assembly
202 mast righting assistance operational subassembly
204 mast righting assistance column subassembly
210 trailer hitch extension subassembly
212 trailer hitch extension receiver tube
213 trailer hitch extension receiver tubular interior wall
214 trailer hitch extension receiver locking aperture
218 trailer hitch extension receiver locking member
219 trailer hitch extension receiver locking member retention aperture
220 winch subassembly
222 winch motor
224 winch cable
225 winch cable free end loop
226 block
228 shackle
232 trailer hitch extension insert
234 trailer hitch extension insert locking aperture
240 column subassembly receiver
243 column subassembly receiver tubular interior wall
244 column subassembly receiver locking aperture
248 column subassembly receiver locking member
250 base column member
252 base column member adjustment apertures
254 base column member tubular interior wall
258 first intermediate column height locking member
260 central column member
262 central column member adjustment apertures
264 central column member tubular interior wall
268 second intermediate column height locking member
270 upper column member
272 upper column member adjustment apertures
274 upper column member tubular interior wall
276 upper column member block attachment aperture
278 block attachment member
279 block attachment member nut
280 winch controller
282 winch controller collection button
284 winch controller dispense button
300 vehicle
310 vehicle hitch receiver assembly
312 vehicle hitch receiver tube
313 vehicle hitch receiver tubular interior wall
314 vehicle hitch receiver locking aperture
318 vehicle hitch receiver locking member
319 vehicle hitch receiver locking member retention aperture
320 vehicle battery
330 trailer hitch assembly
332 trailer hitch insert
334 trailer hitch insert locking aperture
336 trailer hitch ball mount
338 trailer hitch ball
400 mast raising flow diagram
410 assemble mast to hinge assembly step
420 establish desired height for column step
422 secure block to top of column step
424 thread winch cable through block step
430 connect winch cable and mast control line to one another step
432 secure lateral control members step
440 raise mast by retracting cable using winch step
450 secure forestay when mast is upright step
452 disconnect winch cable and mast control line from one another step
460 launch sailboat step
500 mast lowering flow diagram
510 assemble mast to hinge assembly step
520 establish desired height for column step
522 secure block to top of column step
524 thread winch cable through block step
530 connect winch cable and mast control line to one another step
532 secure lateral control members step
540 remove slack from winch cable step
542 release forestay step
550 lower mast by unspooling cable using winch step
552 seat mast within crutch step
554 disconnect winch cable and mast control line from one another step
556 disassembly mast base from mast pivot assembly step
560 position and secure mast for transport step
A1 force application angle respective to stowed mast
A2 force application angle respective to partially raised mast
A3 force application angle respective to raised mast

What is claimed is:

1. A method for stepping and unstepping a mast, the method comprising steps of:

installing a trailer hitch extension insert of a mast righting assistance assembly into a hitch receiver assembled to a vehicle, the mast righting assistance assembly comprising:

a trailer hitch extension subassembly including the trailer hitch extension insert extending in a first longitudinal direction and a trailer hitch extension receiver tube extending in a second, opposite longitudinal direction, a winch carried by the trailer hitch extension subassembly, a generally vertically oriented column extending upwards from the trailer hitch extension subassembly, a winch cable arranged to be spooled onto and unspooled from a drum operated by the winch, and a winch cable redirecting component attached to an upper region of the generally vertically oriented column, wherein the mast is pivotally assembled to a sailboat, wherein the sailboat is seated upon a trailer, wherein a tongue of the trailer is attached to a trailer hitch, wherein the trailer hitch is assembled to the trailer hitch extension receiver tube of the trailer hitch extension subassembly;

routing the winch cable from the drum, redirected via the winch cable redirecting component and secured to a free end of a mast control line, an opposite, attached end of the mast control line being secured to an upper region of the mast;

in a mast stepping process, a length of the winch cable is collected onto the drum causing the mast to rise; and in a mast unstepping process, a length of the winch cable is unspooled from the drum causing the mast to lower.

2. The method for stepping and unstepping the mast as recited in claim 1, the method further comprising steps of:

installing at least one lateral motion control member between an upper portion of the mast and a lateral location on the sailboat; and controlling lateral movement of the mast during one of the stepping process and the unstepping process using the at least one lateral motion control member.

3. The method for stepping and unstepping the mast as recited in claim 1, wherein the winch includes an electrically powered motor, the method further comprising steps of:

in a mast stepping process, directing the electrically powered motor to rotate the drum in a direction to collect the length of the winch cable onto a drum causing the mast to rise, and in a mast unstepping process, directing the electrically powered motor to rotate the drum in a direction to unspool the length of the winch cable from the spool of the winch causing the mast to lower.

4. The method for stepping and unstepping the mast as recited in claim 3, further comprising a winch controller to control operation of the electrically powered motor, the method further comprising steps of:

in a mast stepping process, directing the electrically powered motor to rotate the drum in a direction to collect the length of the winch cable onto a drum causing the mast to rise by actuating a collection button on the winch controller, and in a mast unstepping process, directing the electrically powered motor to rotate the drum in a direction to unspool the length of the winch cable from the spool of the winch causing the mast to lower by actuating a dispense button on the winch controller.

5. The method for stepping and unstepping the mast as recited in claim 1, the method further comprising steps of:

assembling the generally vertically oriented column to the trailer hitch extension subassembly for use during stepping and unstepping of the mast; and disassembling the generally vertically oriented column from the trailer hitch extension subassembly for storage during transport.

6. The method for stepping and unstepping the mast as recited in claim 1, wherein the generally vertically oriented column is adjustable in height, the method further comprising steps of:

determining a minimum height of the generally vertically oriented column required to achieve a minimum force application angle respective to stowed mast; and adjusting a height of the generally vertically oriented column to the determined minimum height of the generally vertically oriented column.

7. The method for stepping and unstepping the mast as recited in claim 1, wherein the generally vertically oriented column is telescopic enabling adjustment in a height of the generally vertically oriented column, the method further comprising steps of:

determining a minimum height of the generally vertically oriented column required to achieve a minimum force application angle respective to stowed mast; and adjusting a height of the generally vertically oriented column to the determined minimum height of the generally vertically oriented column by expanding or contracting the telescoping generally vertically oriented column.

8. A method for stepping and unstepping a mast, the method comprising steps of:

installing a trailer hitch extension insert of a mast righting assistance assembly into a hitch receiver assembled to a vehicle, the mast righting assistance assembly comprising:

a trailer hitch extension subassembly including the trailer hitch extension insert extending in a first longitudinal direction and a trailer hitch extension receiver tube extending in a second, opposite longitudinal direction, a winch subassembly comprising an electrically operated motor arranged to rotate a drum, the winch assembly carried by the trailer hitch extension subassembly, a generally vertically oriented column extending upwards from the trailer hitch extension subassembly, a winch cable arranged to be spooled onto and unspooled from a drum operated by the winch, and a winch cable redirecting component attached to an upper region of the generally vertically oriented column, wherein the mast is pivotally assembled to a sailboat, wherein the sailboat is seated upon a trailer, wherein a tongue of the trailer is attached to a trailer hitch, wherein the trailer hitch is assembled to the trailer hitch extension receiver tube of the trailer hitch extension subassembly;

routing the winch cable from the drum, redirected via the winch cable redirecting component and secured to a free end of a mast control line, an opposite, attached end of the mast control line being secured to an upper region of the mast;

in a mast stepping process, operating the winch motor to collect a length of the winch cable onto the drum causing the mast to rise; and in a mast unstepping process, operating the winch motor to unspool a length of the winch cable from the drum causing the mast to lower.

9. The method for stepping and unstepping the mast as recited in claim 8, the method further comprising steps of:

installing at least one lateral motion control member between an upper portion of the mast and a lateral location on the sailboat; and controlling lateral movement of the mast during one of the stepping process and the unstepping process using the at least one lateral motion control member.

10. The method for stepping and unstepping the mast as recited in claim 8, further comprising a winch controller to control operation of the electrically powered motor, the method further comprising steps of:

in a mast stepping process, directing the electrically powered motor to rotate the drum in a direction to collect the length of the winch cable onto a drum causing the mast to rise by actuating a collection button on the winch controller, and in a mast unstepping process, directing the electrically powered motor to rotate the drum in a direction to unspool the length of the winch cable from the spool of the winch causing the mast to lower by actuating a dispense button on the winch controller.

11. The method for stepping and unstepping the mast as recited in claim 8, the method further comprising steps of:

assembling the generally vertically oriented column to the trailer hitch extension subassembly for use during stepping and unstepping of the mast; and disassembling the generally vertically oriented column from the trailer hitch extension subassembly for storage during transport.

12. The method for stepping and unstepping the mast as recited in claim 8, wherein the generally vertically oriented column is adjustable in height, the method further comprising steps of:

determining a minimum height of the generally vertically oriented column required to achieve a minimum force application angle respective to stowed mast; and adjusting a height of the generally vertically oriented column to the determined minimum height of the generally vertically oriented column.

13. The method for stepping and unstepping the mast as recited in claim 8, wherein the generally vertically oriented column is telescopic enabling adjustment in a height of the generally vertically oriented column, the method further comprising steps of:

determining a minimum height of the generally vertically oriented column required to achieve a minimum force application angle respective to stowed mast; and adjusting a height of the generally vertically oriented column to the determined minimum height of the generally vertically oriented column by expanding or contracting the telescoping generally vertically oriented column.

14. A method for stepping and unstepping a mast, the method comprising steps of:

installing a trailer hitch extension insert of a mast righting assistance assembly into a hitch receiver assembled to a vehicle, the mast righting assistance assembly comprising:

a trailer hitch extension subassembly including the trailer hitch extension insert extending in a first longitudinal direction and a trailer hitch extension receiver tube extending in a second, opposite longitudinal direction, a winch carried by the trailer hitch extension subassembly, a generally vertically oriented column extending upwards from the trailer hitch extension subassembly, wherein the generally vertically oriented column is adjustable in height, a winch cable arranged to be spooled onto and unspooled from a drum operated by the winch, and a winch cable redirecting component attached to an upper region of the generally vertically oriented column, wherein the mast is pivotally assembled to a sailboat, wherein the sailboat is seated upon a trailer, wherein a tongue of the trailer is attached to a trailer hitch, wherein the trailer hitch is assembled to the trailer hitch extension receiver tube of the trailer hitch extension subassembly;

adjusting a height of the generally vertically oriented column to a determined minimum height of the generally vertically oriented column establishing a minimum force application angle respective to stowed mast;

routing the winch cable from the drum, redirected via the winch cable redirecting component and secured to a free end of a mast control line, an opposite, attached end of the mast control line being secured to an upper region of the mast;

in a mast stepping process, a length of the winch cable is collected onto the drum causing the mast to rise; and in a mast unstepping process, a length of the winch cable is unspooled from the drum causing the mast to lower.

15. The method for stepping and unstepping the mast as recited in claim 14, the method further comprising steps of:

installing at least one lateral motion control member between an upper portion of the mast and a lateral location on the sailboat; and controlling lateral movement of the mast during one of the stepping process and the unstepping process using the at least one lateral motion control member.

16. The method for stepping and unstepping the mast as recited in claim 14, wherein the winch includes an electrically powered motor, the method further comprising steps of:

in a mast stepping process, directing the electrically powered motor to rotate the drum in a direction to collect the length of the winch cable onto a drum causing the mast to rise, and in a mast unstepping process, directing the electrically powered motor to rotate the drum in a direction to unspool the length of the winch cable from the spool of the winch causing the mast to lower.

17. The method for stepping and unstepping the mast as recited in claim 14, wherein the winch includes an electrically powered motor, the method further comprising a step of:

connecting a power cable from the electrically powered motor of the winch to a power system of the vehicle.

18. The method for stepping and unstepping the mast as recited in claim 14, further comprising a winch controller to control operation of the electrically powered motor, the method further comprising steps of:

in a mast stepping process, directing the electrically powered motor to rotate the drum in a direction to collect the length of the winch cable onto a drum causing the mast to rise by actuating a collection button on the winch controller, and in a mast unstepping process, directing the electrically powered motor to rotate the drum in a direction to unspool the length of the winch cable from the spool of the winch causing the mast to lower by actuating a dispense button on the winch controller.

19. The method for stepping and unstepping the mast as recited in claim 14, the method further comprising steps of:

assembling the generally vertically oriented column to the trailer hitch extension subassembly for use during stepping and unstepping of the mast; and disassembling the generally vertically oriented column from the trailer hitch extension subassembly for storage during transport.

20. The method for stepping and unstepping the mast as recited in claim 14, wherein the generally vertically oriented column is telescoping, the method further comprising a step of:

adjusting the height of the generally vertically oriented column to the determined minimum height of the generally vertically oriented column by using the telescoping function of the generally vertically oriented column.

* * * * *